US009675159B2

(12) United States Patent
Bitoh

(10) Patent No.: US 9,675,159 B2
(45) Date of Patent: Jun. 13, 2017

(54) DRAWING APPARATUS AND CONTROL METHOD OF DRAWING APPARATUS

(71) Applicant: CASIO COMPUTER CO., LTD., Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 223 days.

(21) Appl. No.: 14/341,201

(22) Filed: Jul. 25, 2014

(65) Prior Publication Data

US 2015/0027480 A1 Jan. 29, 2015

(30) Foreign Application Priority Data

Jul. 26, 2013 (JP) ..... 2013-155106

(51) Int. Cl.
*G06K 15/22* (2006.01)
*A45D 29/00* (2006.01)

(52) U.S. Cl.
CPC ..... *A45D 29/00* (2013.01); *A45D 2029/005* (2013.01)

(58) Field of Classification Search
None
See application file for complete search history.

(56) References Cited

U.S. PATENT DOCUMENTS 4,135,245 A * 1/1979 Kemplin ..... B43L 13/024 346/139 R
4,369,158 A * 1/1983 Woodruff ..... A45D 40/04 264/268
4,384,298 A * 5/1983 LaBarre ..... G01D 9/40 346/129

(Continued)

FOREIGN PATENT DOCUMENTS

JP S59-045200 A 3/1984
JP 2002-165632 A 6/2002

(Continued)

OTHER PUBLICATIONS

Notification of Reasons for Refusal dated Mar. 14, 2017 received in Japanese Patent Application No. JP 2013-155106 together with an English language translation.

*Primary Examiner* — Ted Barnes
(74) *Attorney, Agent, or Firm* — Scully, Scott, Murphy & Presser, P.C.

(57) ABSTRACT

According to one implementation, there is provided a drawing apparatus including a carriage, a cap member, and a holding/separating mechanism. The carriage holds a drawing tool including a tip. The cap member includes a tip receiving unit which covers and seals the tip. The holding/separating mechanism holds the tip of the drawing tool in a sealing state with the tip receiving unit when the drawing tool is placed in a standby position, and separates the tip of the drawing tool and the cap member from each other before starting the drawing. The holding/separating mechanism (Continued)

includes a move prevention member which is fixed to a certain position. The move prevention member comes into contact with the drawing tool so that the move prevention member prevents the drawing tool from moving in a direction that separates the tip from the cap member in the sealing state.

7 Claims, 10 Drawing Sheets

(56) References Cited

U.S. PATENT DOCUMENTS 4,533,924 A * 8/1985 Takahashi ..... B41J 2/49 346/139 R
4,754,288 A * 6/1988 Lawrence ..... B43L 13/024 346/139 R
4,756,086 A * 7/1988 Yajima ..... B43L 13/026 33/1 M
4,970,662 A * 11/1990 Tanaka ..... G01D 15/28 346/139 R
5,018,893 A * 5/1991 Holloway ..... A45D 40/04 401/175
5,102,249 A * 4/1992 Holloway ..... A45D 40/10 401/116
5,119,114 A * 6/1992 Cary ..... G01D 15/28 346/139 C
5,547,301 A * 8/1996 Kageyama ..... B43K 24/06 401/109
5,931,166 A * 8/1999 Weber ..... A45D 34/04 132/200
6,190,076 B1 * 2/2001 Yeh ..... B43K 5/005 401/131
6,231,254 B1 * 5/2001 Holloway ..... A45D 40/04 132/318
6,276,860 B1 * 8/2001 Nakajima ..... B43K 8/08 401/199
6,286,517 B1 * 9/2001 Weber ..... A45D 29/00 132/200
6,347,635 B1 * 2/2002 Jenkins ..... A45D 29/00 132/73
6,363,943 B1 * 4/2002 Jenkins ..... A45D 29/00 132/73
6,419,412 B1 * 7/2002 Ostrowski ..... A45D 40/04 222/153.07
7,280,247 B2 * 10/2007 Silverbrook ..... B41J 2/14 347/29
7,309,184 B2 * 12/2007 Butcher ..... A45D 34/04 401/172
2006/0291949 A1 * 12/2006 Holloway ..... A45D 40/06 401/78
2011/0070013 A1 * 3/2011 Shamitoff ..... B43K 5/005 401/108

FOREIGN PATENT DOCUMENTS

JP 2003-534083 A 11/2003
JP 2004-268537 A 9/2004

* cited by examiner

DRAWING APPARATUS AND CONTROL METHOD OF DRAWING APPARATUS

CROSS-REFERENCE TO RELATED APPLICATIONS

This application is based upon and claims the benefit of priority from the prior Japanese Patent Application No. 2013-155106, filed Jul. 26, 2013, the entire contents of all of which are incorporated herein by reference.

BACKGROUND OF THE INVENTION

1. Field of the Invention

The present invention relates to a drawing apparatus and a control method of the drawing apparatus. Specifically, the present invention relates to a drawing apparatus for drawing an image on fingernails of hands and toenails of feet, and a control method of such drawing apparatus.

2. Description of the Related Art

A nail print apparatus is conventionally known and such apparatus includes a print head which prints using an ink jet method. The nail print apparatus prints a design image including color or a picture on a surface of a nail of a finger of a person. Such nail print apparatus is described in, for example, see Japanese Patent Application Laid-Open Publication No. 2003-534083.

A print head used in the ink jet method prints on a recording medium by discharging droplets of ink from a nozzle provided on a face facing a print target so that the ink lands on the recording medium and is fixed.

However, the print head using the ink jet method has a nozzle with a hole with a small diameter. Therefore, there are limits such as ink including color material having particles with large diameters or ink with high viscosity cannot be used. Therefore, there have been limits in the nail design that could be printed.

In view of the above, a print apparatus using a plotter method is known, and such apparatus includes a drawing head with a pen attached. An image is drawn by bringing a tip portion of the pen in contact with a sheet (drawing screen). According to such print apparatus using the plotter method, since a pen is used, there are few limits of the ink that can be used. It is possible to consider employing such print apparatus using the plotter method as a nail print apparatus to perform nail print with bright colors using various ink.

However, the ink used in nail print dries easily. Therefore, the ink in the pen tip of the pen at the standby position may dry and the start of the drawing may be blurred. Moreover, if the print apparatus is left as is with the pen attached to the print apparatus for a long period of time, the ink at the pen tip dries completely and hardens, and further drawing may not be possible.

Turning to a print apparatus using the plotter method, The pen employed in the plotter comes into contact with a drawing screen with its own weight. If a cap which covers the pen tip is provided in a standby position, it is possible to drop the pen tip with its own weight in the cap at the standby position and to put the cap on the pen tip.

However, it is not possible to achieve enough sealing of the pen tip by merely placing the pen tip in the cap with its own weight and covering the cap on the pen tip.

Therefore, in employing the print apparatus with the above configuration in nail print, when the amount of time that the pen is in the standby position becomes long, the ink in the pen tip may dry, and the start of drawing could be blurred. Further, if the pen is left attached to the apparatus for a long period of time, the ink in the pen tip may dry and harden, and it may not be possible to use the pen any more. Therefore, the apparatus could not be put away in a state with the pen attached to the apparatus. The pen needed to be attached to the apparatus each time the apparatus is used and to be detached from the apparatus after the use of the apparatus. The pen needed to be stored so that the drying of the pen tip is prevented. Therefore, management of the pen has been troublesome.

SUMMARY OF THE INVENTION

The present invention has been conceived in view of the above problems, and one of the main objects is to provide a drawing apparatus and a control method of a drawing apparatus in which the drying of the pen tip is prevented and drawing is readily possible even if the pen is left attached to the apparatus.

In order to obtain the above advantages, according to an aspect of the present invention, there is provided a drawing apparatus including:

a carriage which holds at least one drawing tool including a tip which draws on a drawing target;

a cap member which includes a tip receiving unit in which the tip of the drawing tool can be inserted and which is shaped to cover and seal the tip when the tip of the drawing tool is inserted; and a holding/separating mechanism which holds the cap member, holds the tip of the drawing tool in a sealing state sealed with the cap member when the drawing tool is placed in a standby position, and separates the tip of the drawing tool and the cap member from each other before starting the drawing, wherein, the holding/separating mechanism includes a move prevention member which is fixed to a certain position; and the move prevention member comes into contact with the drawing tool so that the move prevention member prevents the drawing tool from moving in a direction that the tip is separated from the cap member when the holding/separating mechanism holds the tip of the drawing tool in the sealing state.

In order to obtain the above advantages, according to another aspect of the present invention, there is provided a control method of a drawing apparatus, wherein the drawing apparatus includes, a carriage which holds at least one drawing tool including a tip which draws on a drawing target;

a cap member which includes a tip receiving unit in which the tip of the drawing tool can be inserted and which is shaped to cover and seal the tip when the tip of the drawing tool is inserted; and a move prevention member which is fixed to a certain position, the control method including:

moving at least one of the drawing tool and the cap member so that the drawing tool and the cap member come close to each other, and holding the tip of the drawing tool in a sealing state sealed with the cap member when moving the drawing tool to a standby position;

moving at least one of the drawing tool and the cap member so that the drawing tool and the cap member are separated from each other, and separating the tip of the drawing tool and the cap member from the sealing state before starting the drawing; and preventing the drawing tool from moving in a direction where the tip is separated from the cap member by bringing the move prevention member into contact with the drawing tool when the tip of the drawing tool is held in the sealing state.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
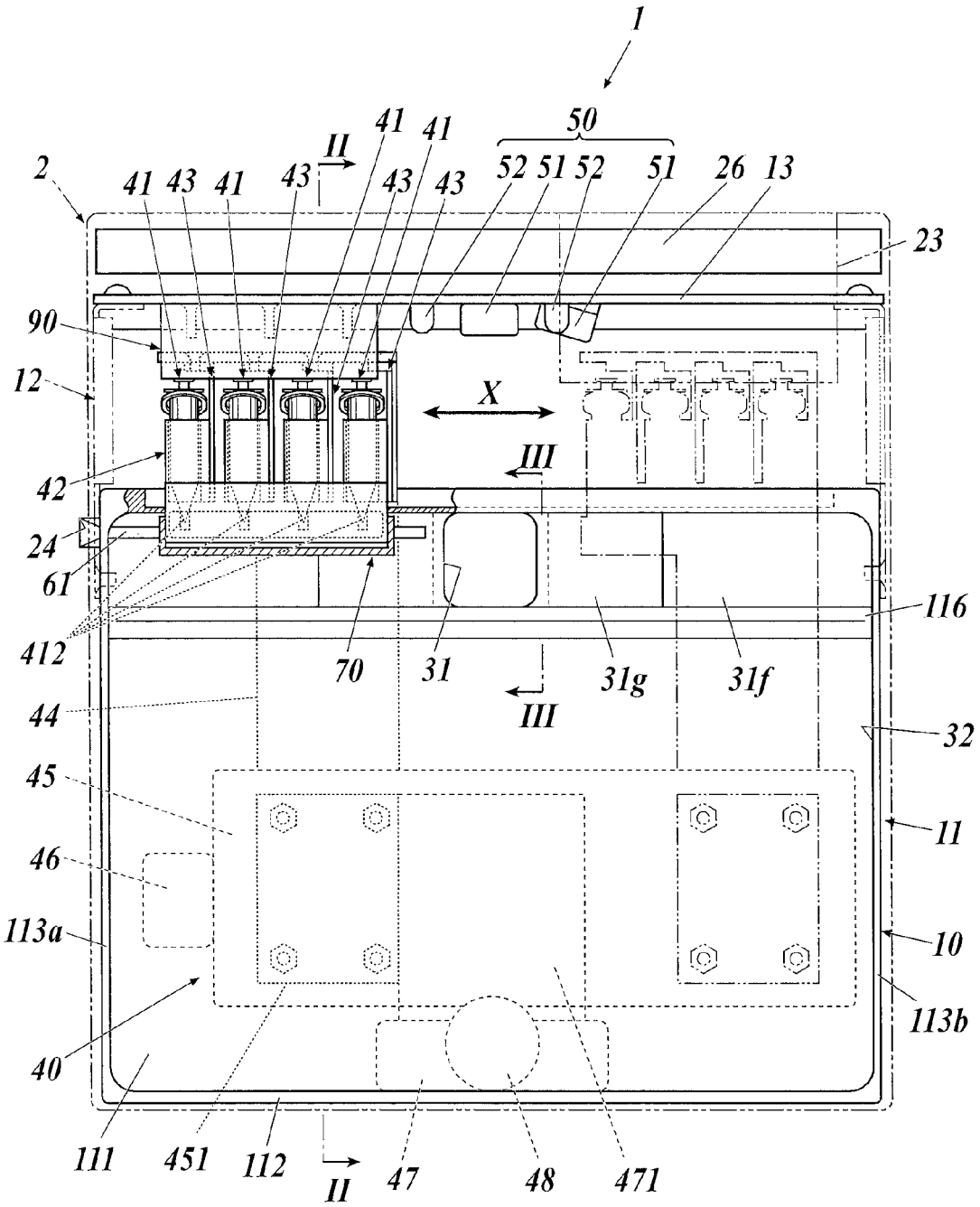
FIG. 1 is a front view of a nail print apparatus according to a first embodiment.

Embodiments of a drawing apparatus of the present invention is described in detail with reference to the drawings.

The embodiments described below include various technical limitations to implement the present invention. However, the scope of the invention is not limited to the embodiments and the illustrated examples described below.

In the following embodiments, the drawing apparatus is described as a nail print apparatus which draws an image on a fingernail of a hand as a target.

The target on which the drawing apparatus draws is not limited to the fingernail of the hand, and the target may be a toenail of a foot. Further, the target on which the drawing apparatus draws is not limited to the nails of the hand or the foot, and can be anything on which an image can be drawn.

First Embodiment

A first embodiment of a nail print apparatus (drawing apparatus) of the present invention is described with reference to FIG. 1 to FIG. 8.

FIG. 1 is a front view showing an internal configuration of a nail print apparatus 1.

Figure 2:
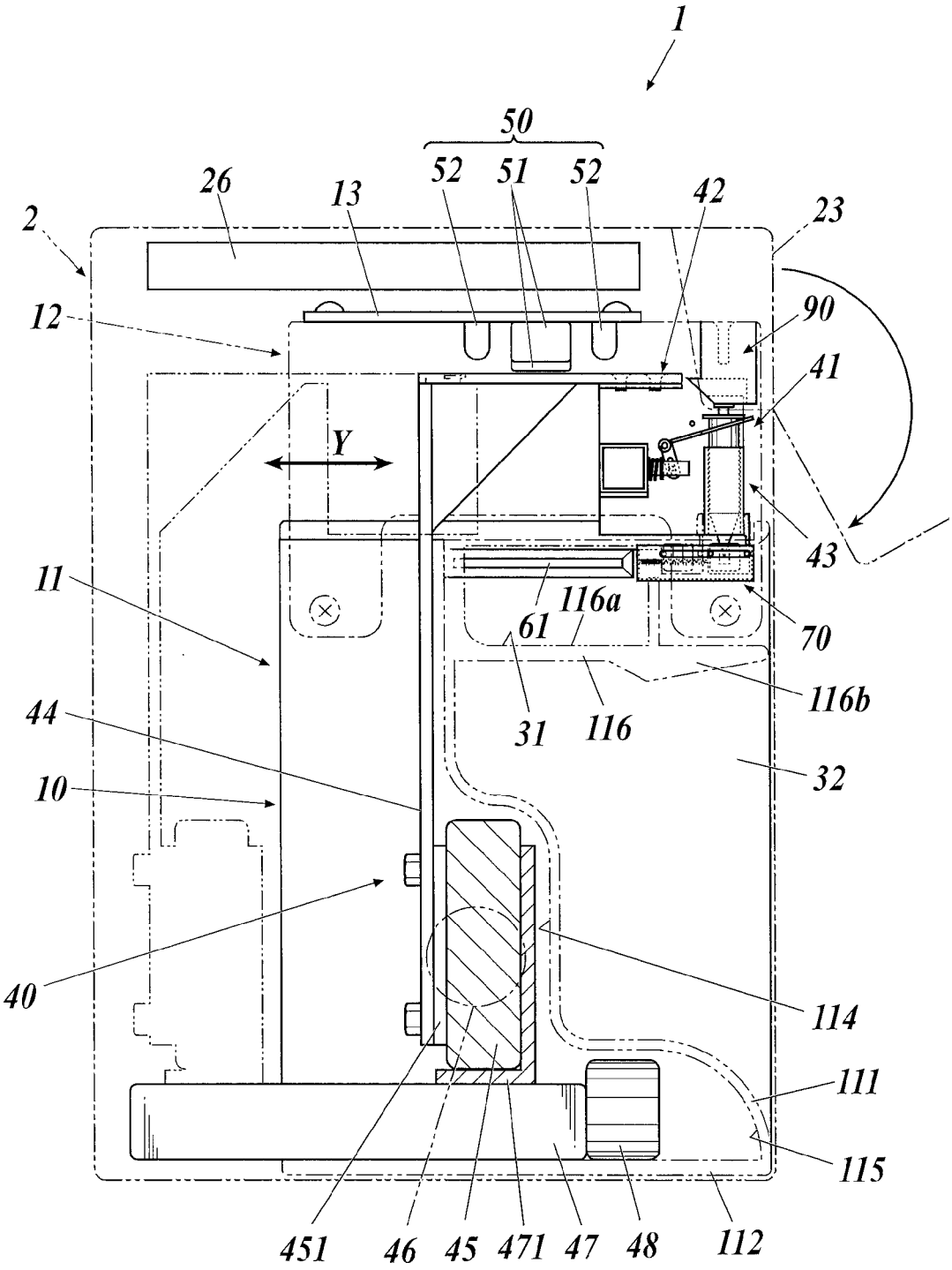
FIG. 2 is a cross sectional view along line II-II shown in FIG. 1.

FIG. 2 is a cross sectional view showing a cross section along line II-II shown in FIG. 1 viewed in a direction of the arrow.

As shown in FIG. 1 and FIG. 2, the nail print apparatus (drawing apparatus) 1 includes a case main body 2, and an apparatus main body 10 accommodated in the case main body 2.

A pen exchange lid unit 23 which is able to open and close to exchange a later described pen 41 (drawing tool) of a drawing unit 40 is provided at one edge of an upper portion of the front face of the case main body 2. The pen exchange lid unit 23 is able to rotate from a closed state to an open state as shown in FIG. 2 by, for example, a hinge.

Further, a media insert/eject opening 24 is formed in a position corresponding to a later described pen conditioning writing unit 61 at one side face of a case main body 2 (according to the present embodiment, left side face in FIG. 1), and a drawing medium (not shown) placed on the pen conditioning writing unit 61 can be exchanged.

An operating unit 25 (see FIG. 8) is provided on a top face (top plate) of the case main body 2.

The operating unit 25 is an input unit where the user performs various input.

Various operating buttons (not shown) to input various instructions are provided in the operating unit 25. Examples of such operating buttons are, for example, a power source switch button to turn ON the power of the nail print apparatus 1, a stop switch button to stop operation, a design select button to select a design image drawn on a nail T, a drawing start button to instruct start of drawing, and the like.

A display unit 26 is provided in a substantially center portion of the top face (top plate) of the case main body 2.

The display unit 26 includes, for example, a Liquid Crystal Display (LCD), an organic electroluminescence display, or other flat display, etc.

In the present embodiment, the following are suitably displayed on the display unit 26, for example, a nail image obtained by capturing a print finger U1 (finger image including image of nail T), an image of outline, etc. of nail T included in the nail image, a design selection screen to select the design image to be drawn on the nail T, a thumbnail image to confirm design, an instruction screen to display various instructions, etc.

A touch panel can be formed together as one with a surface of the display unit 26. In this case, various input can be performed by, for example, a stylus pen (not shown) which is an instrument in a pointed stick shape for writing to write by pressing the surface of the touch panel, or touch operation by touching the surface of the display unit 26 with the fingertip, etc.

The apparatus main body 10 is formed substantially in a box shape, and includes a lower portion machine casing 11 provided in a lower portion inside the case main body 2, and an upper portion machine casing 12 provided above the lower portion machine casing 11 and in an upper portion inside the case main body 2.

First, the lower portion machine casing 11 is described.

The lower portion machine casing 11 includes a back face plate 111, a base plate 112, a pair of left and right side plates 113*a* and 113*b*, an X-direction moving stage accommodating unit 114, a Y-direction moving stage accommodating unit 115, and a partition 116.

Lower edge portions of the side plates 113*a* and 113*b* are each connected to left and right edge portions of the base plate 112, and the side plates 113*a* and 113*b* are provided in a state standing with respect to the base plate 112.

A lower portion of the back face plate ill is formed sinking to the front (finger inserting direction near side) in two steps.

A lower edge portion of the back face plate 111 is connected to a front edge portion of the base plate 112. The back face plate 111 partitions a region surrounded by the base plate 112 and the side plates 113*a* and 113*b* between front and back.

A space formed on a back side of the sunken back face plate 111 is the X-direction moving stage accommodating unit 114 and the Y-direction moving stage accommodating unit 115 (see FIG. 2).

An X-direction moving stage 45 of the drawing unit 40 is accommodated in the X-direction moving stage accommodating unit 114 when the drawing unit 40 moves forward (finger inserting direction near side).

A Y-direction moving stage 47 of the drawing unit 40 is positioned in the Y-direction moving stage accommodating unit 115.

The partition 116 is provided inside the lower portion machine casing 11 to partition the front side of the space inside the lower portion machine casing 11 (finger inserting direction near side space surrounded by the back face plate 111, the base plate 112, and the side plates 113*a* and 113*b*) to an upper space and a lower space.

The partition 116 is provided substantially horizontal, and left and right edge portions of the partition 116 are each connected to the side plates 113*a* and 113*b*, and the back edge portion of the partition 116 is connected to the back face plate 111.

A finger fixing unit 30 is provided as one with the lower portion machine casing 11.

The finger fixing unit 30 is described with reference to FIG. 3.

Figure 3:
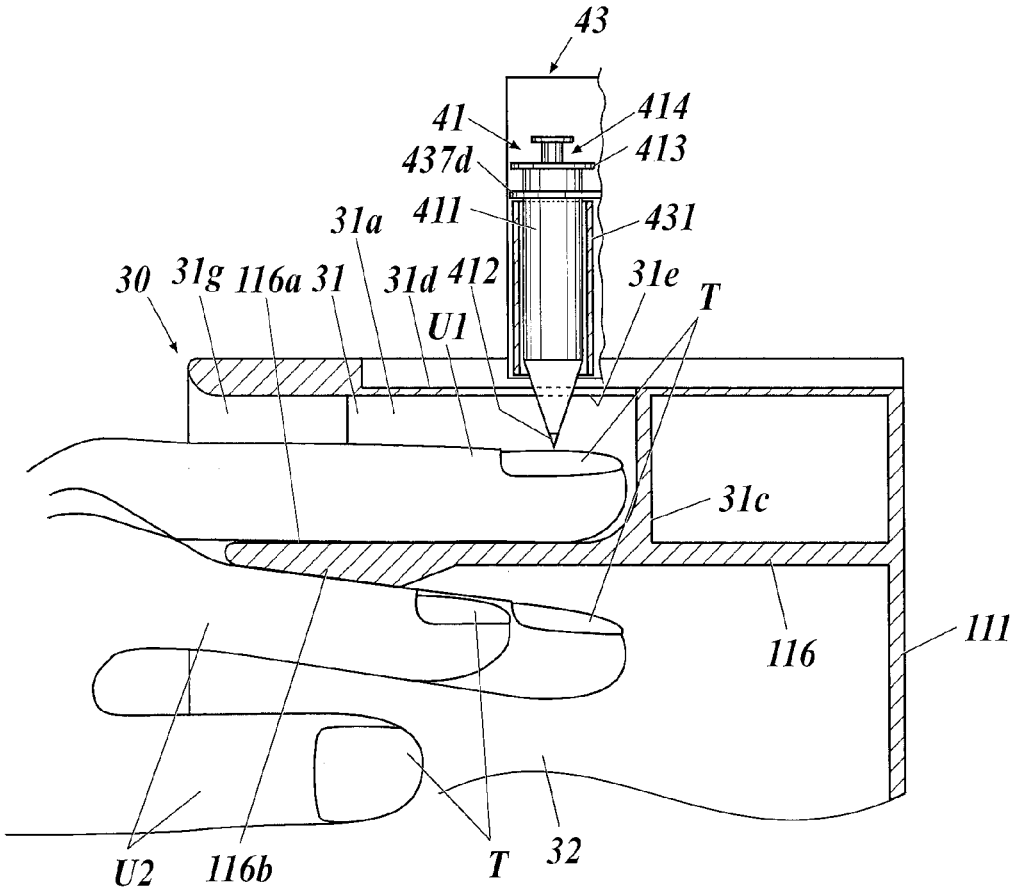
FIG. 3 is a cross sectional view along line shown in FIG. 1.

FIG. 3 is a cross sectional view showing a cross section along line shown in FIG. 1 viewed in the direction of the arrow. FIG. 3 shows a state where a pen tip 412 of the pen 41 comes into contact with a surface of the nail T and draws on the nail T.

The finger fixing unit 30 includes a finger receiving unit 31 which receives a finger corresponding to a nail T on which an image is drawn (hereinafter referred to as "print finger U1") and a finger evacuating unit 32 to which a finger other than the print finger U1 is evacuated (hereinafter referred to as "non-print finger U2").

The finger receiving unit 31 is positioned on an upper side of the partition 116 in substantially the center portion in the width direction of the lower portion machine casing 11.

The space on the lower side of the space of the lower portion machine casing 11 partitioned by the partition 116 is the finger evacuating unit 32.

For example, as shown in FIG. 3, when an image is drawn on a nail T of a ring finger, a ring finger is inserted in the finger receiving unit 31 as the print finger U1. The other four fingers (thumb, index finger, middle finger, and little finger) which are the non-print fingers U2 are inserted in the finger evacuating unit 32.

The finger receiving unit 31 is open to the front face side (near side in the print finger inserting direction) of the lower portion machine casing 11. The bottom side is partitioned by a finger placing unit 116*a* which is a portion of the partition 116, both sides are partitioned by a divider 31*a*, and the far side is partitioned by a divider 31*c*.

The finger placing unit 116*a* is where the finger of the nail T on which an image is drawn (print finger U1) is placed on a XY plane.

The upper side of the finger receiving unit 31 is partitioned by a ceiling unit 31*d*.

A window 31*e* is formed in the ceiling unit 31*d* to expose the nail T of the print finger U1 inserted in the finger receiving unit 31.

A front wall 31*f* is provided standing in both side portions of the front face side of the lower portion machine casing 11 on the top face of the partition 116 to cover a front face side of the lower portion machine casing 11.

A pair of guide walls 31*g* are provided standing on the top face of the partition 116, narrow toward the finger receiving unit 31 from an edge portion near the center portion of the front wall 31*f* to guide the print finger U1 in the finger receiving unit 31.

The user is able to pinch the partition 116 between the print finger U1 inserted in the finger receiving unit 31 and the non-print finger U2 inserted in the finger evacuating unit 32. Therefore, the print finger U1 inserted in the finger receiving unit 31 is stably fixed.

According to the present embodiment, a projecting unit 116*b* projecting in a downward direction is formed at the front edge portion of the partition 116.

The projecting unit 116*b* can be a tapered portion where the thickness gradually decreases towards the near side and gradually increases toward the far side, or a structure where the entire thickness of the projecting unit 116*b* is thick compared to the sunken portion in the far side of the partition 116.

Since the projecting unit 116*b* is formed in the front edge portion of the partition 116, a space is secured between the partition 116 and the nail T of the finger with the image drawn when the non-print finger U2 is inserted in the finger evacuating unit 32. Therefore, it is possible to prevent the nail T coming into contact with the bottom face of the partition 116. Consequently, it is possible to prevent the ink attaching to the apparatus and the picture drawn on the nail T smudging and becoming destroyed.

The pen conditioning writing unit 61 for writing to condition the later described pen 41 is provided on a top face of the lower portion machine casing 11 besides the finger receiving unit 31 (a position corresponding to the medium insert/eject opening 24 of the case main body 2, and according to the present embodiment, the left side in FIG. 1) within a range where a later described drawing head 42 can draw.

The pen conditioning writing unit 61 is formed so that a portion of the top face of the lower portion machine casing 11 is caved. Preferably, the pen conditioning writing unit 61 is provided so that the height of the pen conditioning writing unit 61 is almost the same height as the nail T when the print finger U1 is inserted in the finger receiving unit 31.

The pen conditioning writing unit 61 is a flat plate shaped portion where the drawing medium inserted from the medium insert/eject opening 24 of the case main body 2 is placed.

The drawing medium placed on the pen conditioning writing unit 61 can be any medium with which the pen tip (tip portion) 412 can be conditioned, for example, a piece of paper.

The pen conditioning writing unit 61 is where the pen 41 is lowered on the drawing medium before starting drawing on the nail T according to image data, and a predetermined figure such as a circle or an infinity mark is drawn for conditioning in order to prevent the start of drawing from becoming blurred due to the pen tip 412 being dry, the take in of ink being poor, or the like. With this, the state of the pen tip 412 becomes preferable. The predetermined figure to be drawn in writing for conditioning is not limited. However, it is preferable that the figure is simple such as a circle or an infinity mark so that ink is not used too much and wasted. It is preferable that the position where the figure is written for conditioning is shifted a little each time the figure is written for conditioning within the range of the pen conditioning writing unit 61.

When almost the entire face of the drawing medium is written and there is no space to draw, a display screen urging exchange of the drawing medium such as "please exchange paper" is displayed on the display unit 26.

In this case, the user takes out the drawing medium from the medium insert/eject opening 24 and exchanges this with a new one. With this, writing for conditioning is done on a new drawing medium.

For example, when the drawing medium is a roll sheet, and there is no more space for drawing, the drawing medium is rolled out from the roll sheet, and the writing for conditioning is done on the new drawing face.

According to the present embodiment, the front of the pen conditioning writing unit 61 (near side in the finger inserting direction, right side in FIG. 2) is the standby position where the pen 41 stands by when the pen is not used for drawing.

A pen cap mechanism 70 is provided in the standby position to strongly put the cap member 73 on the tip side of the pen 41 and to cover the pen tip 412 with the cap member 73 when the pen is not used for drawing.

Figure 4:
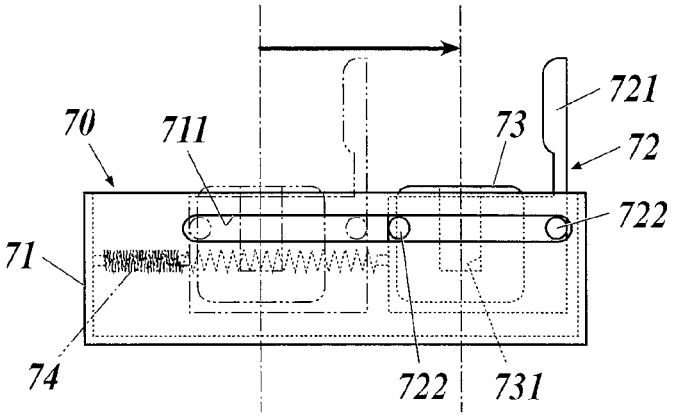
FIG. 4 is a side view of a pen cap mechanism according to the first embodiment.

FIG. 4 is a side view schematically showing the pen cap mechanism 70.

As shown in FIG. 4, the pen cap mechanism 70 includes the pen cap mechanism outer casing 71, and a sliding member 72 accommodated in the pen cap mechanism outer casing 71.

The pen cap mechanism 70 has a width substantially the same as or more than the width of the drawing head 42 (length in X-direction shown in FIG. 1).

The pen cap mechanism outer casing 71 is a box shaped member which can accommodate the sliding member 72.

A long hole 711 is formed on at least a side face (at least one of the right side face and the left side face in FIG. 1) on one side in the width direction of the pen cap mechanism outer casing 71 extending in a substantial horizontal direction.

The sliding member 72 is a box shaped member accommodating a cap member 73 inside, and a striking unit 721 in a plate shape is provided standing on a near side in the finger inserting direction (right side in FIG. 2 and FIG. 4).

The striking unit 721 strikes a lower portion of a pen carriage 43 when the pen carriage 43 including the pen 41 is moved to the near side in the finger inserting direction.

When the pen carriage 43 is moved to the near side in the finger inserting direction, the striking unit 721 is pressed to the near side in the finger inserting direction. With this, the sliding member 72 slides to the near side in the finger inserting direction as shown by the arrow in FIG. 4.

A protruding unit 722 is provided in a position on an outer side face of the sliding member 72 in a position corresponding to the long hole 711 formed in the pen cap mechanism outer casing 71. The protruding unit 722 fits in the long hole 711.

The sliding member 72 is able to slide in the front and back direction (Y direction in FIG. 2, left and right direction in FIG. 2 and FIG. 4) of the nail print apparatus along the long hole 711 with the protruding unit 722 inserted in the long hole 711.

The present embodiment shows an example in which two protruding units 722 are provided, however, the number of protruding units 722 is not limited.

The cap member 73 accommodated in the sliding member 72 is positioned below the pen 41 when the pen 41 is not used for drawing and covers the pen tip 412 of the pen 41 in the predetermined standby position.

The cap member 73 is formed with a material which has flexibility to a certain degree and which comes into strong contact with the pen tip 412 when pressed by the pen tip 412, for example, various synthetic resin. Specifically, for example, it is possible to apply material which is typically called "soft rubber" or "super soft rubber" and which has a degree of hardness of 30 or less, for example, "chloroprene rubber", "silicone rubber", or "butyl rubber".

A pen tip receiving unit 731 which is substantially a cylinder shaped hole with an opening open at the top portion is formed in the cap member 73. The number of pen tip receiving units 731 formed corresponds to the number of pens 41 attached to the drawing unit 40 (according to the present embodiment, four). As described later, the pen tip 412 is inserted in the pen tip receiving unit 731 from the opening from above. The pen tip receiving unit 731 is formed in a shape which can cover the pen tip 412 and preferably seal the pen tip 412 when the pen tip 412 is inserted in the opening.

One end of a spring 74 is attached to the outer side face on the far side in the finger inserting direction of the sliding member 72 (left side in FIG. 2 and FIG. 4).

The other end of the spring 74 is fixed to the inner side face on the far side of the pen cap mechanism outer casing 71 (left side in FIG. 2 and FIG. 4).

The sliding member 72 is pulled toward the far side in the finger inserting direction (left side in FIG. 2 and FIG. 4) by the spring 74 as shown with alternate long and two short dash lines shown in FIG. 4 when drawing is performed (in other words, the striking unit 721 is not pressed by the pen carriage 43).

Moreover, a pen pressing member 90 which presses the upper edge portion of the pen 41 is provided fixed on a downstream side in a moving direction of the pen 41 moved to the standby position by a head driving unit 49 which is a pen moving mechanism, in other words, on the near side in the finger inserting direction. The pen pressing member 90 is the move prevention member of the present invention.

As shown in FIG. 1 and FIG. 2, the pen pressing member 90 is fixed with a screw to the upper portion machine casing 12.

The pen pressing member 90 is positioned toward the near side (near side in the finger inserting direction, right side in FIG. 2) more than the region that the pen 41 moves in drawing so that the pen pressing member 90 does not come into contact with the pen 41 or the pen carriage 43 when the image is being drawn.

Figure 5A:
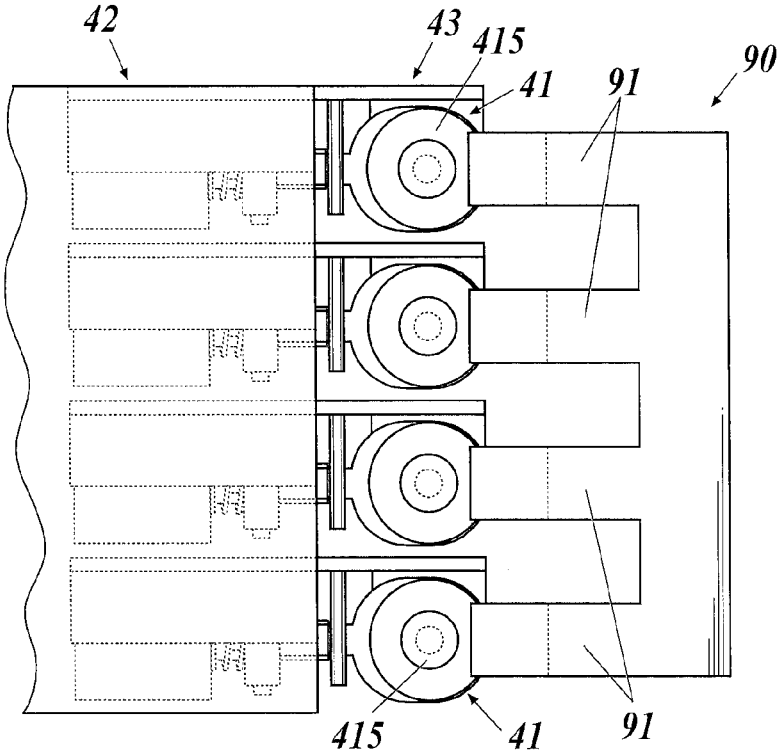
FIG. 5A is a top view showing a relation of the positions between an uncapped pen and a pen pressing member.
Figure 5B:
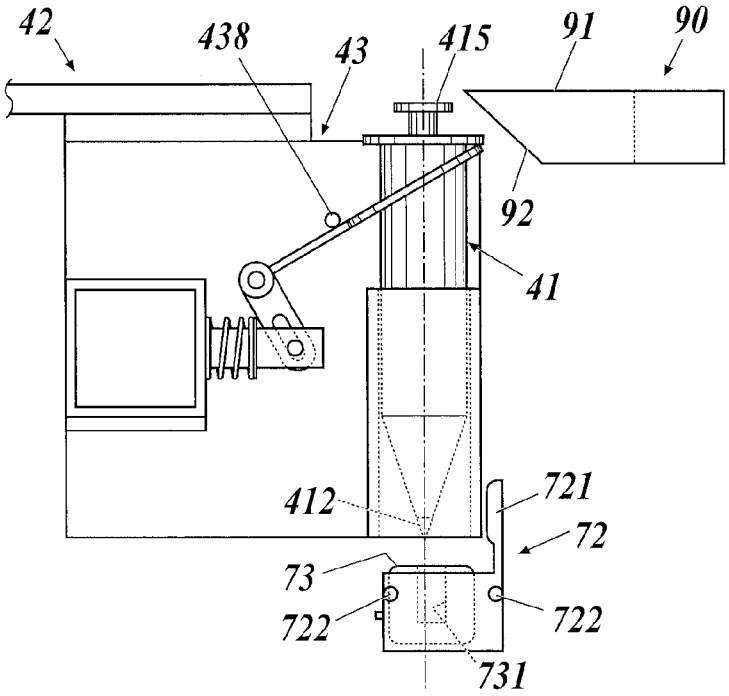
FIG. 5B is a side view showing a relation of the positions among an uncapped pen, a pen pressing member, and a cap member shown in FIG. 5A.
Figure 6A:
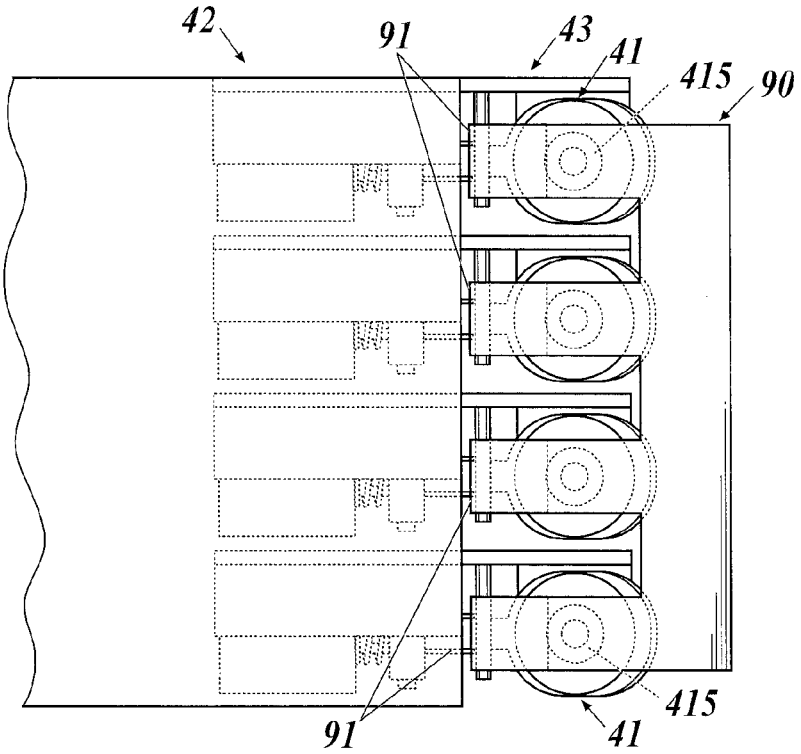
FIG. 6A is a top view showing a relation of the positions between a capped pen and a pen pressing member.
Figure 6B:
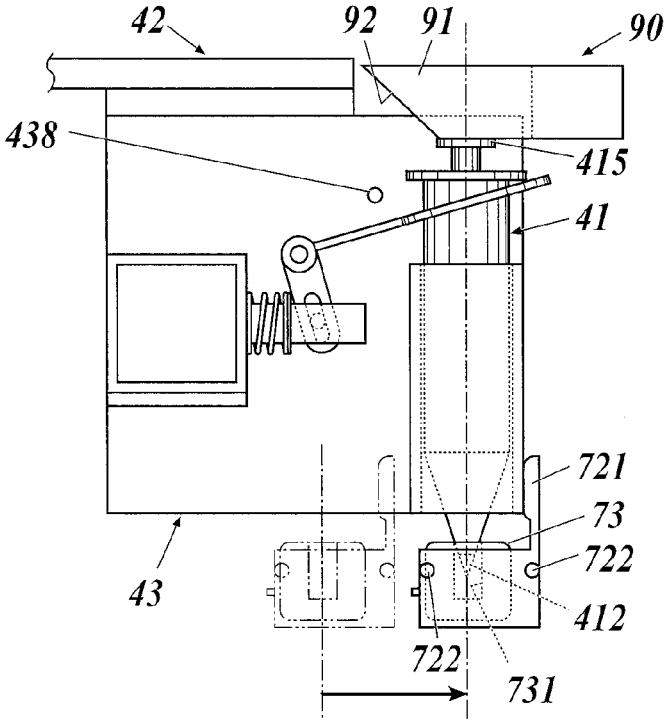
FIG. 6B is a side view showing a relation of the positions among a capped pen, a pen pressing member, and a cap member shown in FIG. 6A.

FIG. 5A, FIG. 5B, FIG. 6A, and FIG. 6B are diagrams showing a relation of the positions between the pen 41 supported by the pen carriage 43, pen pressing member 90, and the cap member 73 when the pen carriage 43 moves to the standby position. FIG. 5A and FIG. 6A are planar views viewed from above, and FIG. 5B and FIG. 6B are side views viewing the state of FIG. 5A and FIG. 6A from the side.

As shown in FIG. 5A and FIG. 6A, the pen pressing member 90 includes pressing units 91 corresponding to the pen 41 attached to the drawing head 42. The number of pressing units 91 provided corresponds to the number of pens 41 attached to the drawing head 42 (according to the present embodiment, four).

As shown in FIG. 5B and FIG. 6B, an inclining face 92 is formed in each pressing unit 91. The inclining face 92 is formed by cutting out the side facing the pen 41 from the far side in the finger inserting direction to the near side diagonally downward. The inclining face 92 strikes the top edge portion of the pen 41 and presses the pen 41 downward when the pen 41 is moved to the standby position.

The pen pressing member 90 is provided so that the inclining face 92 of the pressing unit 91 is positioned above the cap member 73.

As shown in FIG. 5B, when the pen carriage 43 is moved to the standby position, first the lower portion of the pen carriage 43 strikes the striking unit 721 of the sliding member 72 of the pen cap mechanism 70. The pen carriage 43 presses the sliding member 72 and moves to the near side in the finger inserting direction with the sliding member 72.

Then, as shown in FIG. 5A and FIG. 5B, the top edge portion of the pen 41 goes below the inclining face 92 of the pressing unit 91.

When the pen carriage 43 moves further toward the near side in the finger inserting direction, a grip unit 415 which is the top edge portion of the pen 41 strikes the inclining face 92 of the pressing unit 91. According to the movement of the pen carriage 43, the grip portion 415 is gradually pressed downward along the inclination of the inclining face 92.

Here, the pen tip receiving unit 731 of the cap member 73 is positioned below the pen 41 supported by the pen carriage 43 and moves together with the pen carriage 43.

Therefore, the pen tip 412 of the pen 41 pressed down by the inclining face 92 of the pressing unit 91 gradually goes into the pen tip receiving unit 731.

Then, as shown in FIG. 6A and FIG. 6B, when the pen 41 is pressed to the most downward state by the pressing unit 91, the top edge portion (grip unit 415) of the pen 41 finishes going down the inclination of the inclining face 92 and goes below the pressing unit 91.

Here, the pen tip 412 is pressed deeply in the pen tip receiving unit 731 of the cap member 73 and the pen tip 412 is preferably sealed by the pen tip receiving unit 731.

As described above, according to the present embodiment, when drawing is not performed, the pen 41 which is moved toward the near side in the finger inserting direction is pressed downward by the pen pressing member 90 and the pen 41 is moved downward to a position where the pen tip 412 of the pen 41 comes into close contact with the cap member 73.

In other words, the head driving unit 49 which is the pen moving mechanism to move the pen 41 in the horizontal direction and the pen pressing member 90 compose the holding/separating mechanism to move at least one of the pen 41 or the cap 73 in the up and down direction so that the pen 41 and the cap member 73 come into contact with each other or separate from each other.

Here, according to the present embodiment, the cap member 73 is a certain height, and the pen 41 moves in the up and down direction. However, the configuration is not limited to the above, and for example, the pen 41 can be a certain height, and the cap member 73 can move up and down.

The drawing unit 40 includes the drawing head 42 which includes the pen 41 for drawing, a unit supporting member 44 which supports the drawing head 42, the X-direction moving stage 45 which moves the drawing head 42 in the X-direction (X-direction, left and right direction of the nail print apparatus 1 in FIG. 1), an X-direction moving motor 46, the Y-direction moving stage 47 which moves the drawing head 42 in the Y-direction (Y-direction, front and back direction of the nail print apparatus 1 in FIG. 2), a Y-direction moving motor 48, and the like.

According to the present embodiment, the drawing head 42 includes four pen carriages 43. Each pen carriage 43 holds one pen 41.

Figure 7B:
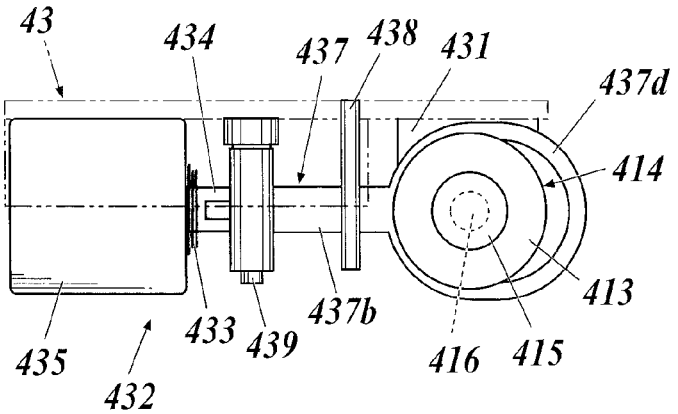
FIG. 7B is a top view of the pen carriage and the pen shown in FIG. 7A viewed from a direction of arrow b.
Figure 7A:
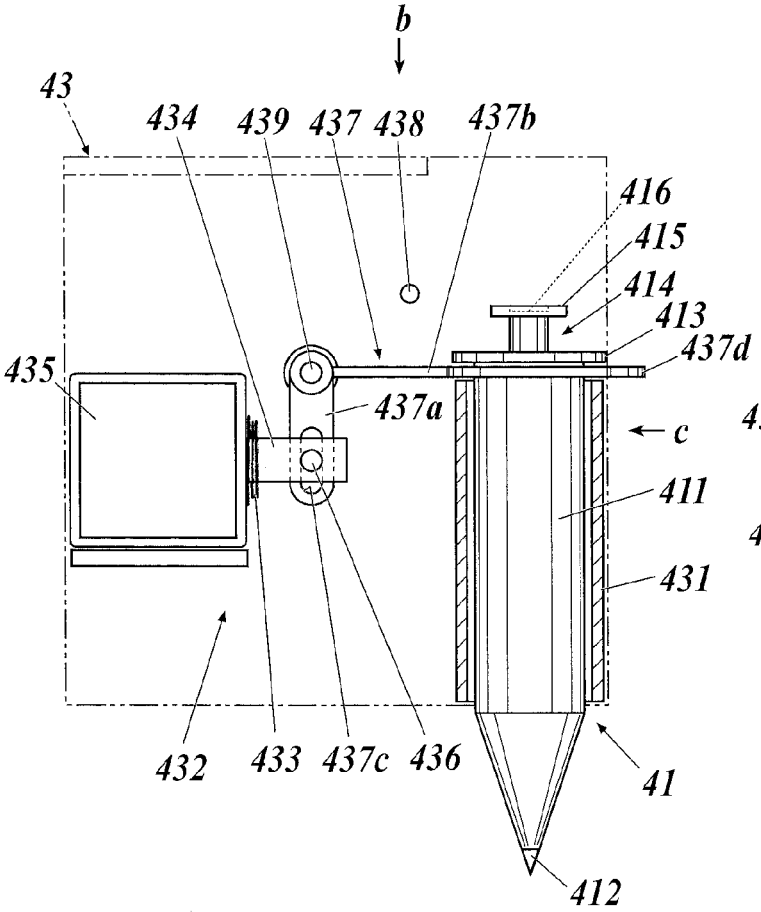
FIG. 7A is an enlarged side view of a pen carriage and a pen supported by the pen carriage in a drawing state.
Figure 7C:
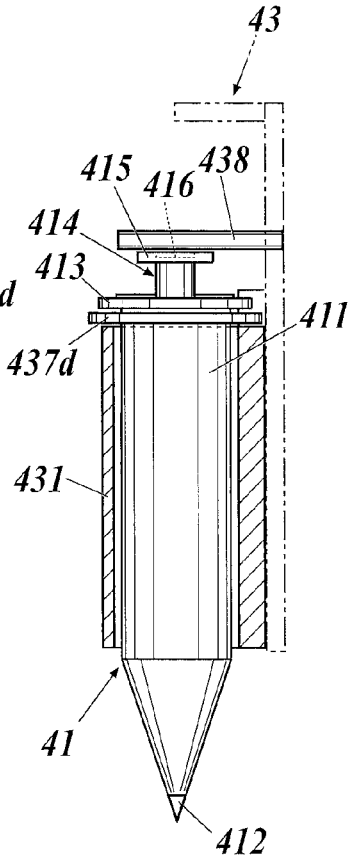
FIG. 7C is a front view of the pen carriage and the pen shown in FIG. 7A viewed from a direction of arrow c.

FIG. 7A to FIG. 7C are diagrams which show the pen carriage 43 and the pen 41 supported by the pen carriage 43 enlarged. FIG. 7A to FIG. 7C show a state (drawing state) where the pen tip 412 comes into contact with the surface of the nail T and performs drawing on the nail T as shown in FIG. 3.

FIG. 7A is a side view of the pen carriage 43 and the pen 41.

FIG. 7B is a top view of the pen carriage 43 and the pen 41 shown in FIG. 7A viewed from the arrow b direction.

FIG. 7C is a front view of the pen carriage 43 and the pen 41 shown in FIG. 7A viewed from the arrow c direction.

As shown in FIG. 7A to FIG. 7C, the pen 41 held by each pen carriage 43 includes a pen tip 412 provided at the tip of a pen axis unit 411.

The inside of the pen axis unit 411 is an ink storage unit which includes various types of ink. The viscosity, particle diameter of the color material (particle size), etc. of the ink stored in the pen axis unit 411 is not limited. For example, ink including gold and silver lame, white ink, UV hardening type-ink, calgel nail, under coat, top coat, nail polish, or the like can be used.

A lid unit 414 is attached to the other end of the pen axis unit 411 and a brim unit 413 expanding outward than the pen axis unit 411 is formed on the lid unit 414.

The material used to form the pen axis unit 411 and the lid unit 414 is not limited. It is preferable that the pen axis unit 411 and the lid unit 414 are formed from resin, etc. in order to make the pen 41 lighter.

According to the present embodiment, the grip unit 415 is provided at the top of the lid unit 414 so that it is easy to grip with the hand, tweezers or the like. Further, a small iron piece 416 is provided buried, adhered, etc. in the grip unit 415 so that the small iron piece 416 is drawn to a magnet.

For example, the pen 41 is a pen where the pen tip 412 is a ball point type, and drawing with the pen 41 is done by pressing the pen tip 412 to the surface of the nail T and the ink stored in the pen axis unit 411 comes out.

The pen 41 is not limited to such ball point type. Various types of pens can be used, for example, the pen can be a felt tip pen type where ink is permeated in a felt like pen tip for drawing or a brush type where ink is permeated in a bundle of hair for drawing.

The pen tip 412 can be prepared with various diameters.

The pens 41 held in the plurality of pen carriages 43 can be pens with the same type of pen tip 412 or pens with different types of pen tips 412.

As described later, the pen 41 is held by simply inserting the pen 41 from above through a pen holding unit 437*d* and a pen holder 431 of the pen carriage 43.

Therefore, exchange can be done easily by opening the pen exchange lid unit 23 provided in the case main body 2 and employing the following methods such as grabbing the grip unit 415 with the hand or tweezers, or bringing a stick shape member (not shown) with a magnet attached to the tip near the grip unit 415 so that the iron piece 416 is drawn to the magnet and the pen 41 is pulled up. Therefore, the user is able to realize a wide variety of nail designs by suitably exchanging pens 41 attached to each pen carriage 43 with different types of pen tips 412 and different types of ink according to the nail design that the user desires to draw.

According to the present embodiment, since four pen carriages 43 holding the pen 41 are aligned in the width direction of the apparatus (left and right direction, X-direction in FIG. 1), the position of the pen tip 412 of each pen 41 varies in the X-direction (left and right direction of the apparatus). However, the amount of the difference is an integral multiple of one step in the drawing operation, and drawing is performed by correcting the position of the pen 41 in the number of steps equal to the amount of the difference depending on the pen 41 used in drawing. Therefore, the four pens 41 can draw in the same position.

Each pen carriage 43 is provided with a pen holder 431 which holds the pen substantially upright, and a pen raising/lowering mechanism 432 which moves the pen 41 up and down.

The pen holder 431 is a tube shaped portion in which the pen tip 412 and the pen axis unit 411 are inserted through to hold the pen 41.

The pen raising/lowering mechanism 432 includes a plunger 434, a solenoid 435, a lever supporting axis 436, a pen raising/lowering lever 437, and a stopper 438.

The plunger 434 has a cylinder shape, and is biased to the front (right side direction in FIG. 2 and FIG. 7A) by a spring 433 and moves back and forth like a piston from the solenoid 435.

The solenoid 435 is a pull type solenoid. For example, the plunger 434 is biased to the front by the spring 433, but when the solenoid 435 is driven, the plunger 434 is pulled to the back by resisting the bias force of the spring 433 (left side direction in FIG. 2 and FIG. 7A).

The lever supporting axis 436 is attached to a moving end side of the plunger 434.

The pen raising/lowering lever 437 is connected to the plunger 434 through the lever supporting axis 436 and is rotatable around a fixed rotating axis 439.

The stopper 438 is provided fixed to limit the upper limit of the rotating angle when the pen raising/lowering lever 437 rotates upward.

As shown in FIG. 7A, the pen raising/lowering lever 437 is an L shaped member where a short arm 437*a* and a long arm 437*b* intersect in a substantial right angle. A long hole 437*c* which latches to the lever supporting axis 436 is formed on the tip side of the short arm 437*a*.

The pen holding unit 437*d* where the pen 41 is inserted through is provided on the tip side of the long arm 437*b*.

The pen holding unit 437*d* is formed with a ring shape including an inner diameter which is larger than the outer diameter of the pen axis unit 411 of the pen 41 and the pen tip 412 and smaller than the outer diameter of the brim unit 413 of the pen 41. The pen axis unit 411 and the pen tip 412 are inserted through the pen holding unit 437*d*. The pen holding unit 437*d* is configured to support the brim unit 413 from the lower side.

A rotating axis 439 is inserted through the intersection between the short arm 437*a* and the long arm 437*b* in the pen raising/lowering lever 437 and is provided fixed to the pen carriage 43 side.

According to the present embodiment, when the solenoid 435 is driven (operating state), as shown in FIG. 7A, the plunger 434 resists the bias force of the spring 433 and is pulled to the back. The pen raising/lowering lever 437 latched to the lever supporting axis 436 of the plunger 434 is held in the position where the long arm 437*b* is substantially horizontal.

In this state, the pen tip of the pen 41 is lowered lower than the pen holder 431 of the pen carriage 43 and is in a drawing state where it is possible to come into contact with the surface of the nail T or the drawing medium.

When the solenoid 435 is in a released state (non-operating state), the plunger 434 projects forward by the bias force of the spring 433.

Here, the pen raising/lowering lever 437 latched to the lever supporting axis 436 of the plunger 434 rotates upward (counterclockwise) around the rotating axis 439 as the fulcrum, the long arm 437*b* comes into contact with the stopper 438, and the pen raising/lowering lever 437 stops.

With this, the brim unit 413 of the pen 41 is thrown up by the pen raising/lowering lever 437 (see FIG. 2).

In this state, the pen tip of the pen 41 is raised higher than the pen holder 431 of the pen carriage 43, and is in a non-drawing state where the pen tip does not come into contact with the surface of the nail T or the drawing medium.

As described above, the force of the solenoid 435 to move the plunger 434 to the front and back is converted to the force to move the pen 41 up and down by the rotating axis 439 and the pen raising/lowering lever 437 which rotates around the rotating axis 439 as the fulcrum.

Alternatively, the solenoid 435 can be a push type in which the plunger 434 is held to the back against the bias force of the spring 433, but when the solenoid 435 is driven, the plunger 434 is pushed. In this case, the operation state and the non-operation state of the solenoid 435 is opposite of the configuration described above.

Since the pen 41 is merely inserted through the pen holder 431 of the pen carriage 43 and held, and is not fixed by the pen raising/lowering lever 437, etc., the pen 41 is biased downward by its own weight.

With this, the pen 41 is lowered freely along the pen holder 431 to the position where the brim unit 413 comes into contact with the top face of the pen holding unit 437*d*. When the pen strikes the surface of the nail T or the drawing medium, the pen tip 412 is pressed to the surface of the nail T or the drawing medium.

In other words, when the image is drawn on the nail T using the pen 41, the pen tip 412 is able to move freely in a Z-direction (in other words, up and down direction) of a XY plane where the print nail U1 is placed according to the surface shape (rough surface, etc.) of the nail T (adjusts to the curve and the height of the nail T).

For example, when an image is drawn on a portion of the nail T where the height is low (for example, both edge portions of the nail T in the width direction, etc.), the pen 41 is lowered to a position near the position where the brim unit 413 comes into contact with the top face of the pen holding unit 437*d*, and when an image is drawn on a portion of the nail T where the height is high (for example, center portion of the nail T in the width direction), the pen 41 rises following the height of the nail T and the brim unit 413 separates from the top face of the pen holding unit 437*d*.

Since the weight of the pen 41 is only a few tens of grams and very light, even if the pen tip 412 strikes the nail T, the user does not feel pain. Moreover, since the pen pressure of the pen 41 is secured by its own weight, it is possible to draw a nail design on the surface of the nail T, etc.

According to the present embodiment, among the members which compose the pen raising/lowering mechanism 432, the rotating axis 436 and the stopper 438 are formed by metal such as stainless steel, and the other members are formed by material which is light and which does not react to a magnet such as resin.

The material of the members which compose the pen raising/lowering mechanism 432 is not limited to the examples illustrated here.

Moreover, according to the present embodiment, the solenoid 435 is used as the actuator to raise and lower the pen 41. However, the actuator to raise and lower the pen 41 is not limited to the solenoid 435. Since the pen 41 is light, other than a solenoid, various small driving devices can be used as an actuator to raise and lower the pen 41.

The unit supporting member 44 which supports the drawing head 42 is fixed to the X-direction moving unit 451 attached to the X-direction moving stage 45.

The X-direction moving unit 451 moves in the X-direction along the guide not shown on the X-direction moving stage 45 driven by the X-direction moving motor 46. With this, the drawing head 42 moves in the X-direction (X-direction shown in FIG. 1, left and right direction of the nail print apparatus 1).

The X-direction moving stage 45 is fixed to the Y-direction moving unit 471 of the Y-direction moving stage 47.

The Y-direction moving unit 471 moves in the Y-direction along the guide not shown on the Y-direction moving stage 47 driven by the Y-direction moving motor 48. With this, the drawing head 42 moves in the Y-direction (Y-direction shown in FIG. 2, front and back direction of the nail print apparatus 1).

According to the present embodiment, the X-direction moving stage 45 and the Y-direction moving stage 47 are composed by combining the X-direction moving motor 46, the Y-direction moving motor 48, and a ball screw and a guide not shown.

According to the present embodiment, a head driving unit 49 which drives the drawing head 42 including the pen 41 to draw on the nail T in the X-direction and the Y-direction is composed of the X-direction moving motor 46 and the Y-direction moving motor 48.

As described above, the head driving unit 49 (specifically, the Y-direction moving motor 48 composing the head driving unit 49) functions as the pen moving mechanism which moves the pen 41 in the horizontal direction, and composes the holding/separating mechanism with the pen pressing member 90 to move the pen 41 in the up and down direction to come into contact and to separate from the cap member 73.

The solenoid 435 to move the pen 41 in the drawing head 42 up and down, the X-direction moving motor 46, and the Y-direction moving motor 48 are connected to a later described drawing control unit 815 of a control apparatus 80 (see FIG. 8), and are controlled by the drawing control unit 815.

As shown in FIG. 1 and FIG. 2, the capturing unit 50 is provided with an upper portion machine casing 12.

In other words, a substrate 13 is provided in the upper portion machine casing 12 and two cameras 51 are provided as the imaging apparatus in the center portion of the lower face of the substrate 13. Preferably, the camera 51 is a camera with pixels of, for example, about 2,000,000 pixels or more.

The camera 51 captures the nail T of the print finger U1 inserted in the finger receiving unit 31 and obtains the nail image (finger image including the image of the nail T) which is the image of the nail T of the print finger U1.

According to the present embodiment, the two cameras 51 are provided substantially aligned in the width direction of the nail T of the print finger U1 inserted in the finger receiving unit 31.

Between the two cameras 51, one camera 51 is provided facing the base face of the finger receiving unit 31 and captures the nail T from directly above. The other camera 51 is provided slightly tilted with respect to the base face of the finger receiving unit 31 along the curved shape of the nail T, and captures the nail T from a direction diagonally above.

An illuminating lamp (illuminating apparatus) 52 such as a white color LED, etc. is provided on the substrate 13 to surround the camera 51. The illuminating lamp 52 illuminates the nail T of the print finger U1 when capturing with the camera 51. The capturing unit 50 includes the camera 51 and the illuminating lamp 52.

The capturing unit 50 is connected to a later described capturing control unit 811 of the control apparatus 80 (see FIG. 8) and is controlled by the capturing control unit 811.

The image data of the image obtained by capturing with the capturing unit 50 is stored in a later described nail image storage region 821 of the storage unit 82.

According to the present embodiment, by using the two cameras 51 as the imaging apparatus, the nail T can be captured from at least two different positions/angles, and at least two nail images are obtained.

Then, based on the above nail images, a later described nail information detecting unit 812 is able to detect nail information such as an inclination angle (hereinafter referred to as "inclination angle of the nail T" or "nail curvature") of the surface of the nail T with respect to the XY plane, perpendicular position of the nail T, etc. in addition to the outline of the nail T (shape of the nail T).

In other words, for example, by taking in the image of the nail T from directly above and the image of the nail T from diagonally above, it is possible to accurately detect not only the outline of the nail T but also the inclination angle of the surface of the nail T.

For example, the control apparatus 80 is provided on the substrate 13, etc. provided in the upper portion machine casing 12.

Figure 8:
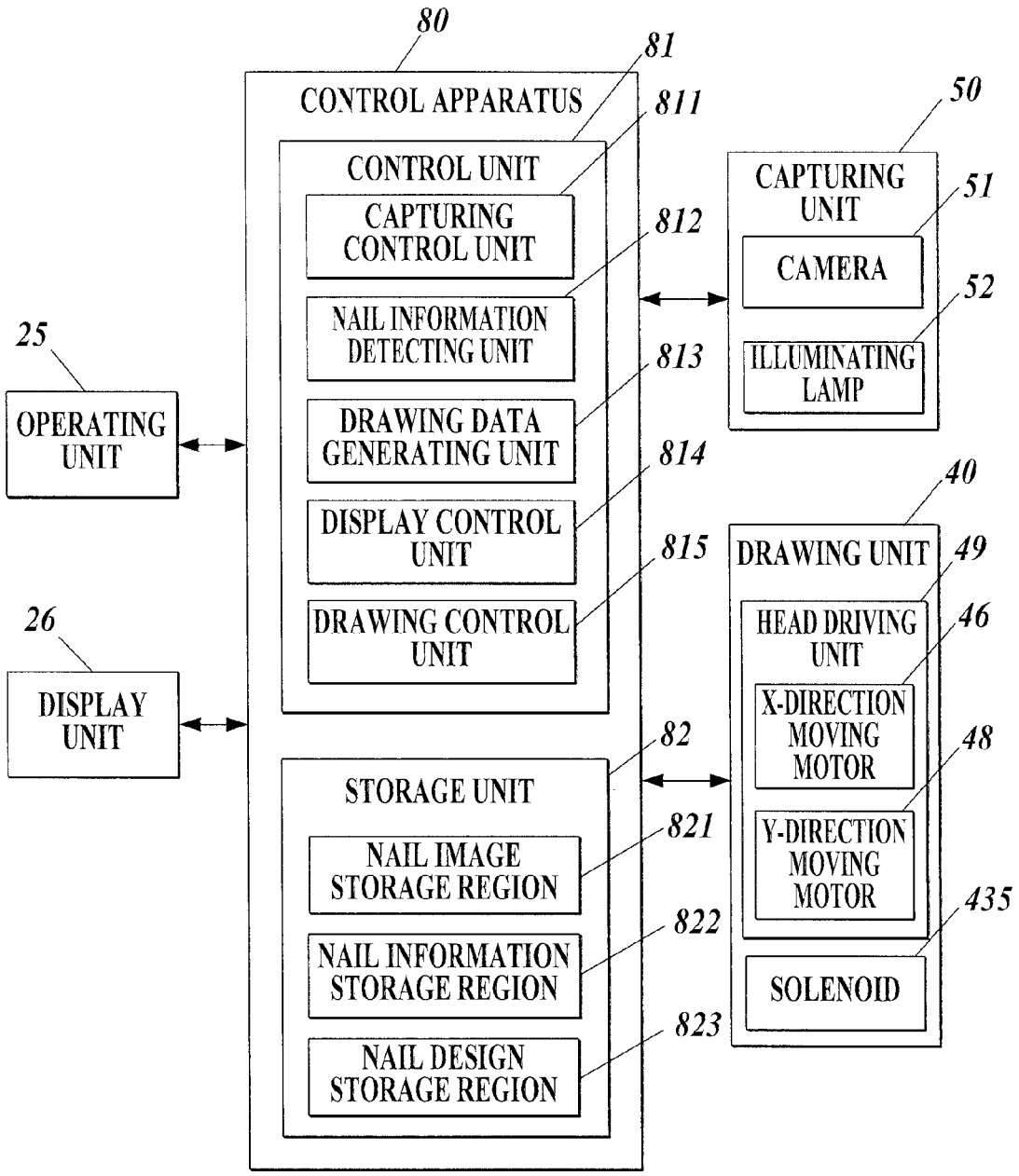
FIG. 8 is a block diagram of main units showing a configuration of control of the nail print apparatus of the present embodiment.

FIG. 8 is a block diagram of the main units showing configuration of control in the present embodiment.

As shown in FIG. 8, the control apparatus 80 is a computer including a control unit 81 including a CPU (Central Processing Unit) not shown, a storage unit 82 including a ROM (Read Only Memory) and a RAM (Random Access Memory) (both not shown).

Various programs and various pieces of data to operate the nail print apparatus 1 are stored in the storage unit 82.

Specifically, various programs are stored in the ROM of the storage unit 82, programs such as a nail information detecting program to detect nail information such as a shape of the nail T, the inclination angle of the nail T, etc. from the nail image, drawing data generating program to generate drawing data, drawing program to perform drawing processing and the like. Such programs are executed by the control apparatus 80 to centrally control each unit of the nail print apparatus 1.

The following are provided in the storage unit 82 of the present embodiment, the nail image storage region 821 to store the nail image of the nail T of the print finger U1 of the user obtained by the capturing unit 50, a nail information storage region 822 to store nail information detected by the nail information detecting unit 812, and a nail design storage region 823 to store image data of the nail design drawn on the nail T.

Functionally, the control unit 81 includes a capturing control unit 811, the nail information detecting unit 812, a drawing data generating unit 813, a display control unit 814, a drawing control unit 815, and the like.

The above functions such as the capturing control unit 811, the nail information detecting unit 812, the drawing data generating unit 813, the display control unit 814, the drawing control unit 815, and the like are implemented by the CPU of the control unit 81 in coordination with the program stored in the ROM of the storage unit 82.

The capturing control unit 811 controls the camera 51 and the illuminating lamp 52 of the capturing unit 50 to capture an image (hereinafter referred to as "nail image") of the finger including the image of the nail T of the print finger U1 inserted in the finger receiving unit 31 with the camera 51.

According to the present embodiment, a capturing control unit 511 uses the two cameras 51 to obtain at least two nail images from different positions and angles (for example, directly above the nail T and diagonally above the nail T, or the like).

The nail information detecting unit 812 detects the nail information of the nail T of the print finger U1 based on the image of the nail T of the print finger U1 inserted in the finger receiving unit 31 captured by the camera 51.

Here, nail information includes information such as the outline of the nail T (nail shape, horizontal position of the nail T), the inclination angle of the surface of the nail T with respect to the XY plane (inclination angle of the nail T, nail curvature), and the height of the nail (position of the nail in the perpendicular direction, hereinafter referred to as "perpendicular position of the nail T", or simply "position of the nail T").

The inclination angle of the nail T (nail curvature) is the angle with respect to the horizontal face (in other words, the XY plane of the finger placing unit 116*a* where the print finger U1 is placed) in the width direction of the nail T.

The nail information obtained by the nail information detecting unit 812 can be only the outline of the nail T (nail shape) or can include information other than the information illustrated here.

The nail information detecting unit 812 of the present embodiment detects the outline of the nail T (nail shape) and the inclination angle of the nail T (nail curvature) among the above nail information based on the nail image.

Specifically, from the nail image of the nail T of the print finger U1 obtained by the camera 51, the nail information detecting unit 812 detects the outline of the nail T (shape and size) and the position, and obtains the outline as information represented by x, y coordinates, etc.

For example, the nail information detecting unit 812 detects the outline (shape) of the nail T based on the difference of the color between the nail T and the other portions of the finger from the nail image of the nail T of the print finger U1 obtained by the camera 51.

The method of how the nail information detecting unit 812 detects the outline (shape) of the nail T is not limited, and the method is not limited to those described here.

The nail information detecting unit 812 detects the inclination angle (nail curvature) of the nail T based on at least two nail images captured by the two cameras 51.

In other words, for example, the nail information detecting unit 812 detects the inclination angle (nail curvature) of the nail T of the user from the difference in the shadow appearing in the two nail images captured from different positions and angles (for example, directly above the nail T, diagonally above the nail T, and the like) by two cameras 51.

The method of how the nail information detecting unit 812 detects the inclination angle (nail curvature) of the nail T is not limited, and the method is not limited to those described here.

The drawing data generating unit 813 generates the data for drawing on the nail T of the print finger U1 with the drawing head 42 based on the nail information detected by the nail information detecting unit 812.

Specifically, the drawing data generating unit 813 performs matching processing by enlarging, reducing, cutting, etc. the image data of the nail design according to the shape of the nail T detected by the nail information detecting unit 812 and generates data to perform drawing on the nail T.

In the present embodiment, the drawing data generating unit 813 calibrates the curve in the image data of the nail design according to the inclination angle of the nail T (nail curvature) which is the print target.

The display control unit 814 controls the display unit 26 and displays various display screens on the display unit 26.

According to the present embodiment, the display control unit 814 displays on the display unit 26 the following, for example, the selection screen of the nail design, the thumbnail image to confirm the design, the finger image capturing the print finger U1, the nail image included in the finger image, screens for receiving various instructions, and the like.

The drawing control unit 815 is a control unit which outputs the drawing data generated by the drawing data generating unit 813 to the drawing unit 40, and controls the solenoid 435, the X-direction moving motor 46, and the Y-direction moving motor 48 of the drawing unit 40 to draw the image according to the drawing data on the nail T.

According to the present embodiment, the drawing control unit 815 moves the pen carriage 43 supporting the pen 41 to the standby position provided to the front of the pen conditioning writing unit 61 when drawing is not performed.

Specifically, the drawing control unit 815 controls the X-direction moving motor 46 so that the pen carriage 43 is moved in the X-direction to the position corresponding to the pen cap mechanism 70 which is where the standby position is provided.

The drawing control unit 815 further controls the Y-direction moving motor 48 so that the pen carriage 43 is moved toward the near side (near side in the finger inserting direction, right side in FIG. 2, FIG. 6B, etc.) in the Y direction to the position where the top edge portion of the pen 41 is pressed to the lowest position by the pressing unit 91.

Next, the operation and the method of use of the nail print apparatus 1 according to the present embodiment is described.

When drawing is performed by the nail print apparatus 1, first, the user turns on the power source switch and starts the control apparatus 80.

The display control unit 814 displays the design selection screen on the display unit 26.

The user operates the operating button 251, etc. of the operating unit 25 and selects the desired nail design from the plurality of nail designs displayed on the design selection screen.

With this, the selection instruction signal is output from the operating unit 25 and the nail design drawn on the nail T is selected.

When the nail design is selected, the control unit 81 displays on the display unit 26 an instruction screen to urge the user to set the pen 41 necessary for drawing the selected nail design in the predetermined pen carriage 43 of the drawing head 42.

For example, when red ink and gold ink with lame are necessary, the control unit 81 instructs on the display unit 26 which pen 41 with which ink is attached to which pen carriage 43.

The user sets the predetermined type of pen 41 in the predetermined pen carriage 43 according to the instruction displayed on the display screen.

The user can also set the pen 41 which is different from the instruction to enable a nail design with the desired color or texture.

It is possible to set the configuration so that the control unit 81 is able to read with a barcode, etc. which type of pen 41 is set in the pen carriage 43. In this case, the nail design which can be drawn by the pen 41 set in the pen carriage 43 is displayed on the design selection screen of the display unit 26, and the user is able to select the nail design from above.

Next, the user inserts the print finger U1 in the finger receiving unit 31, inserts the non-print finger U2 in the finger evacuating unit 32, fixes the print finger U1 in the predetermined position, and operates the drawing switch.

For example, in FIG. 3, the ring finger of the left hand is inserted in the finger receiving unit 31 as the print finger U1 and the other fingers are inserted in the finger evacuating unit 32 as the non-print finger U2.

When the instruction from the drawing switch is input, before starting the drawing operation, first the capturing control unit 811 controls the capturing unit 50 and captures the print finger U1 with the two cameras 51 while illuminating the print finger U1 with the illuminating lamp 52.

With this, the capturing control unit 811 obtains at least two images of the nail T (nail image) of the print finger U1 inserted in the finger receiving unit 31.

Next, the nail information detecting unit 812 detects the outline of the nail T (nail shape) and the inclination angle of the nail T (nail curvature) based on the obtained nail image.

When the nail information detecting unit 812 detects the outline of the nail T (nail shape) and the inclination angle of the nail T (nail curvature), the drawing data generating unit 813 performs processing to match the image data of the nail design to the nail T based on the above nail information.

The drawing data generating unit 813 calibrates the curve of the image data of the nail design based on the above nail information. With this, the drawing data is generated.

Before starting drawing on the nail T, the drawing control unit 815 moves the drawing head 42 to the pen conditioning writing unit 61. Then, the drawing control unit 815 drives the solenoid 435 of the pen carriage 43 holding the pen 41 to set the pen 41 in a state where drawing is possible.

Then, a predetermined figure such as a circle or infinity mark is drawn on the drawing medium in the pen conditioning writing unit 61 for writing to condition the pen 41.

The writing for conditioning the pen 41 can be done by only pens 41 which are necessary for drawing the selected nail design or by all pens 41.

When the drawing data is generated and the writing for conditioning is finished, the drawing control unit 815 outputs the drawing data to the drawing unit 40, and drives the solenoid 435 of the pen carriage 43 which holds the pen 41 necessary for drawing to set the pen 41 to a state where drawing is possible. Then, the drawing head 42 is moved suitably in the XY direction based on the drawing data to draw on the nail T.

Here, the pen 41 is pressed to the surface of the nail T by its own weight, and draws while moving up and down according to the shape of the surface of the nail T.

When an image is drawn on the nails T of a plurality of fingers, after the drawing processing on the nail T of one finger is finished, the finger with the nail T with an image already drawn is pulled out from the finger receiving unit 31, and the finger with the nail T on which the image is drawn next is inserted in the finger receiving unit 31 as the print finger U1, the nail image of the nail T is obtained, and the above processing is repeated.

After the pen 41 is attached to the pen carriage 43, until the start of drawing (for example, while the nail design is selected) or after the end of drawing (in other words, non-drawing state), the drawing control unit 815 first moves the drawing head 42 in the X-direction to the position corresponding to the pen cap mechanism 70 which is where the standby position is provided.

When the drawing head 42 is moved to the position corresponding to the pen cap mechanism 70 in the X-direction, the drawing control unit 815 moves the drawing head 42 to the near side in the finger inserting direction (right side in the Y-direction in FIG. 2).

Here, when the lower portion of the pen carriage 43 of the drawing head 42 strikes the striking unit 721 of the sliding member 72, the pen carriage 43 moves horizontally to the near side in the finger inserting direction with the sliding member 72 while pushing the sliding member 72.

Then, as shown in FIG. 5A and FIG. 5B, the grip unit 415 which is the top edge portion of the pen 41 goes under the inclining face 92 of the pressing unit 91. When the pen carriage 43 moves further to the near side in the finger inserting direction, the top edge portion of the pen 41 strikes the inclining face 92 of the pressing unit 91 and the top edge portion of the pen 41 is gradually pressed downward along the inclination.

Here, the pen tip receiving unit 731 of the cap member 73 is positioned below the pen 41 supported by the pen carriage 43, and the pen tip 412 pressed by the inclining face 92 of the pressing unit 91 is gradually inserted in the pen tip receiving unit 731.

Then, in the state that the top edge portion of the pen 41 is pressed most downward by the pressing unit 91 (state shown in FIG. 6A and FIG. 6B), the pen tip 412 is pressed deeply in the pen tip receiving unit 731 of the cap member 73. With this, the pen tip receiving unit 731 comes into close contact with the pen tip 412, and the pen tip 412 is preferably sealed.

When the drawing starts, the drawing control unit 815 moves the drawing head 42 to the far side in the finger inserting direction (left side in the Y-direction in FIG. 2).

With this, the pressure on the striking unit 721 by the pen carriage 43 is released, and the sliding member 72 accommodating the cap member 73 is pulled back to the far side in the finger inserting direction (left side in the Y-direction in FIG. 2) by the pulling force of the spring 74.

The pen 41 is released from the pressure above by the pen pressing member 90, and the pen 41 rises to the position where the long arm 437*b* comes into contact with the stopper 438 and stops.

With this, the cap member 73 separates from the pen tip 412, and the drawing head 42 can be moved to the pen conditioning writing unit 61 or the drawing region.

When the pen 41 is exchanged, the drawing control unit 815 moves the drawing head 42 to the position corresponding to the pen exchange lid unit 23. In this state, the user opens the pen exchange lid unit 23, takes out the pen 41, and an exchange can be made.

As described above, according to the nail print apparatus 1 of the present embodiment, when the image is not drawn, the pen tip 412 of the pen 41 is securely inserted in the pen tip receiving unit 731 of the pen cap mechanism 70 and the pen tip 412 is preferably sealed.

Therefore, if the amount of time until the drawing starts is long after the pen 41 is attached, or the pen 41 is left attached to the nail print apparatus 1 for a long period of time, the ink of the pen tip 412 does not dry or become hard and this can prevent the pen 41 from not being able to be used again.

Since the pen tip 412 does not dry easily, the amount of writing for conditioning before drawing can be made relatively small. With this, it is possible to condition the state of the pen tip 412 in a relatively short period of time, and beautiful nail print can be performed.

The nail print apparatus 1 can be put away or kept with the pen 41 attached to the nail print apparatus 1. Therefore, the pen 41 does not have to be removed after use of the nail print apparatus 1 and the pen does not have to be attached each time before use. With this, the user is not troubled by the above, and is able to enjoy nail print using the nail print apparatus 1 with little hassle.

When the image is not drawn, the pen tip 412 of the pen 41 is securely inserted and fixed to the pen tip receiving unit 731. Therefore, the user is able to carry the nail print apparatus 1 with the pen 41 left attached. Even if the apparatus is tilted while the apparatus is being carried, the pen 41 does not fall out of the pen carriage 43.

According to the present embodiment, the head driving unit 49 functions as the pen moving mechanism which moves the pen 41 horizontally. The pen driving unit 49 presses the sliding member 72 including the cap member 73 to a predetermined standby position using the pen carriage 43 with the pen 41 attached. Then, as the pen carriage 43 moves, the pen pressing member 90 presses the pen 41 downward and the pen tip 412 is inserted in the cap member 73.

Therefore, the mechanism to move the pen 41 when the image is drawn can be used to securely insert and cap the pen tip 412 of the pen 41 with the pen tip receiving unit 731 when the image is not drawn. With this, there is no need to provide a separate actuator for capping. Consequently, the configuration of the apparatus can be simplified and made lighter, and further, the cost of the apparatus can be reduced.

According to the present embodiment, since the cap member 73 moves together with the movement of the pen carriage 43, even if the pen 41 is gradually pressed down by the moving pen carriage 43, the pen tip 412 does not bump the edge of the cap member 73, and the pen tip 412 is smoothly inserted in the pen tip receiving unit 731.

Since the image is drawn using the pen 41, compared to drawing using the conventional ink jet type print head, a wide variety of ink can be used, such as ink with high viscosity, ink with gold or silver lame, ink including various color material such as white color ink and the like.

With this, the color of the ink is beautifully shown without a base coat of white, etc. With this, it is possible to omit the trouble of using a base coat. Moreover, designs taking advantage of the base color of the nail T can be drawn, and the variety of the nail design which can be drawn can be widened.

When the under coat or the top coat is applied, or the user desires to color the entire nail T, by using a pen 41 with a broad pen tip 412 or a pen 41 with a brush at the tip, it is possible to apply the above fast and evenly. Therefore, it is possible to omit the trouble of the user having to apply a base coat herself/himself. Also, since the quality does not reduce due to unapplied portions or uneven application, the image of the nail can be completed beautifully.

Since the ink that can be used is not limited, a nail print such as a gorgeous design using ink with lame, or a luxurious design with thickness and gloss are possible, and nail print with the wide variety and beautiful finish as same as service in a nail salon can be easily done on the nail T with the nail print apparatus 1.

For example, ink with high viscosity such as calgel which hardens under ultraviolet rays can be used, therefore, it is possible to realize long lasting, beautifully finished images on the nail as same as service in a nail salon.

The nail information detecting unit 812 detects the shape of the nail, etc. as the nail information based on the nail image. Therefore, it is possible to draw the image to match the nail T of the user, and it is possible to realize beautiful art without portions left uncolored or coloring outside the nail.

The present embodiment shows an example where the pen pressing member 90 is a block shaped member including an inclining face 92 on the bottom side. However, the structure of the pen pressing member is not limited to the above.

Figure 9:
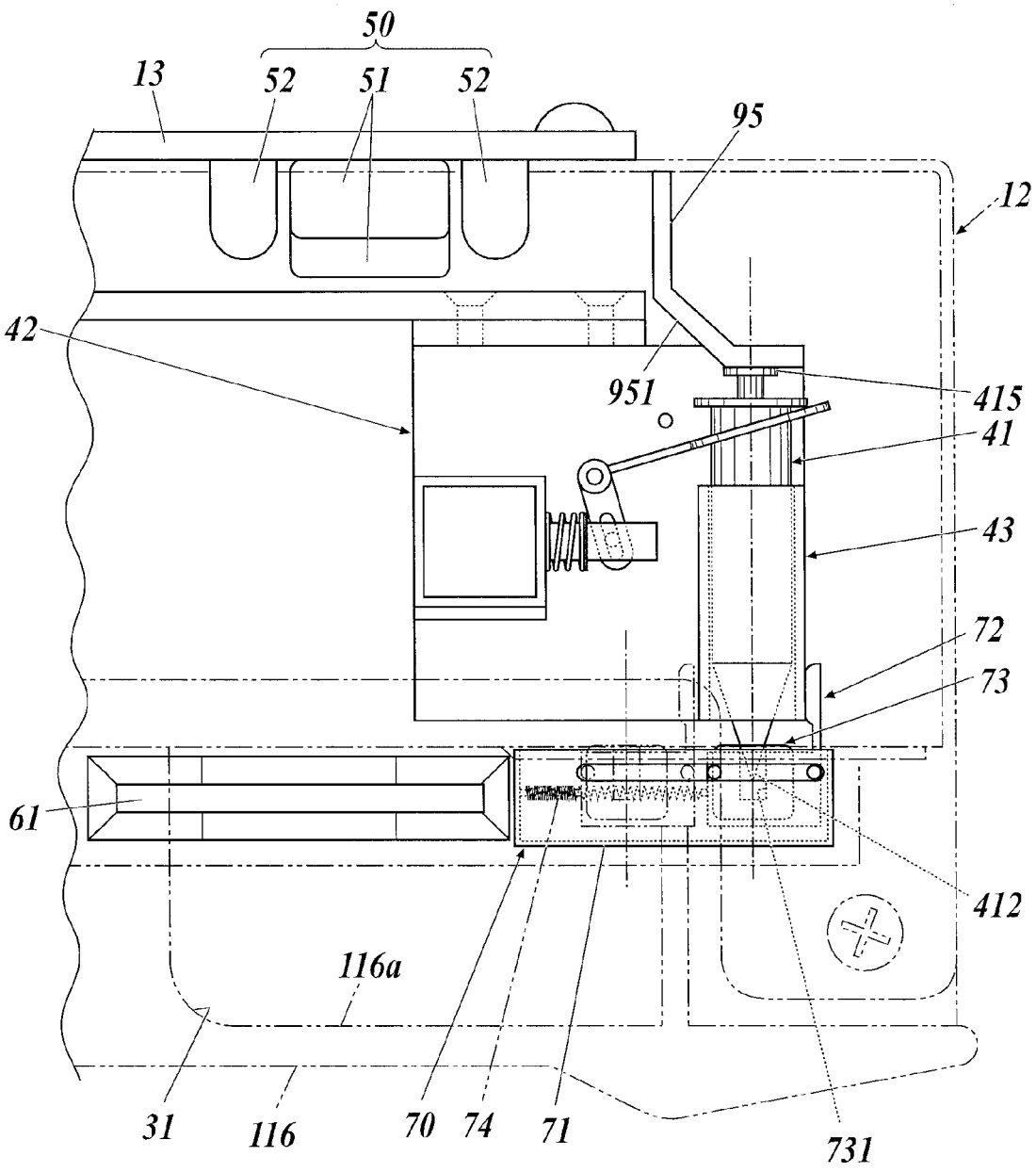
FIG. 9 is a side view showing a modification of a pen pressing member.

For example, the pen pressing member can be a bent plate member 95 formed by bending a metal plate as shown in FIG. 9.

In this case, the bent plate member 95 includes an inclining face 951 in a position opposing to the grip unit 415 at the top edge portion of the pen 41 which is moved to the near side in the finger inserting direction, and which strikes the grip unit 415 and presses the grip unit 415 downward with the movement of the pen 41.

Figure 10:
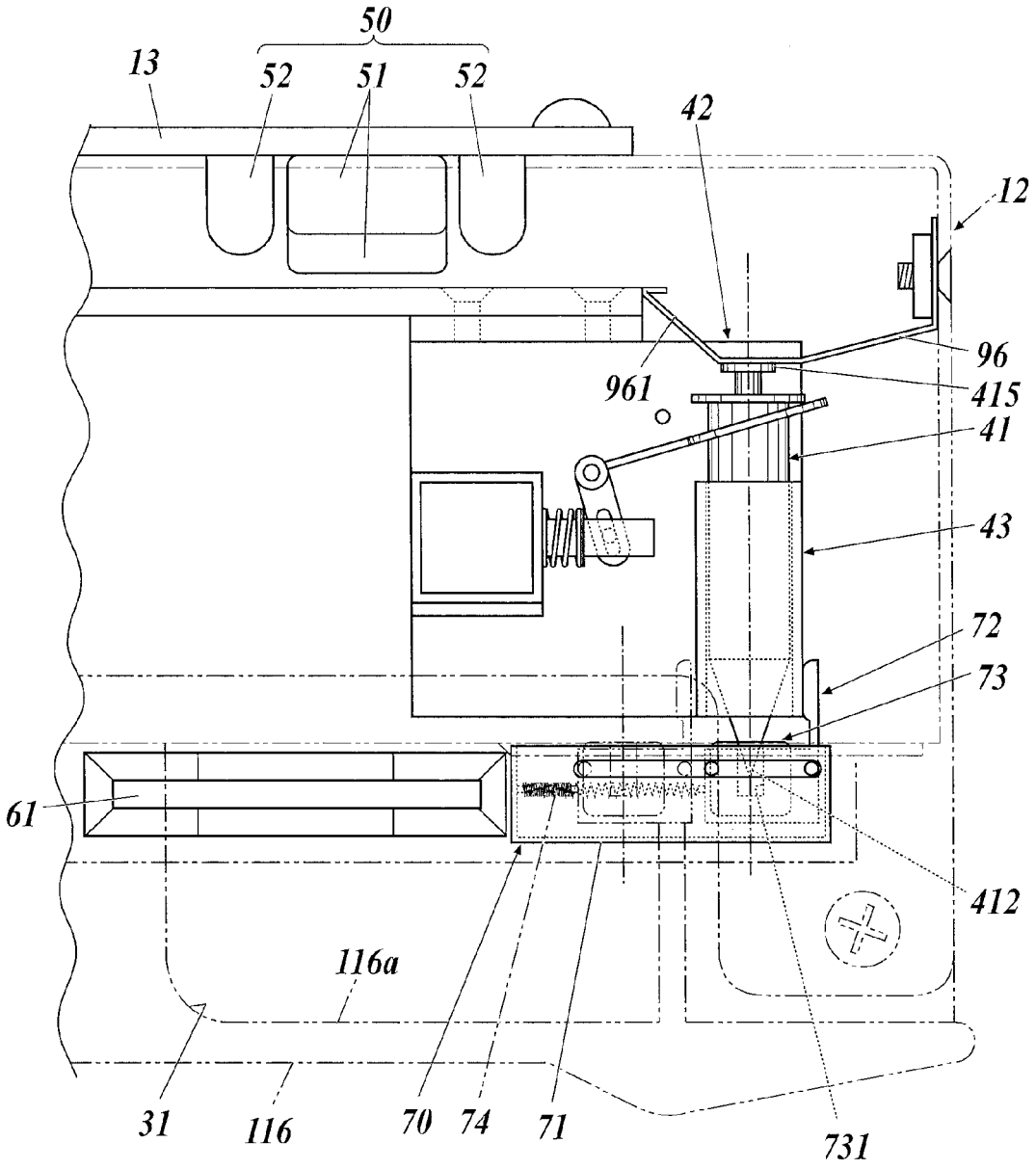
FIG. 10 is a side view showing a modification of a pen pressing member.

For example, the pen pressing member can be the plate spring 96 as shown in FIG. 10. In this case, the plate spring 96 includes an inclining face 961 in a position opposing to the grip unit 415 at the top edge portion of the pen 41 which moves to the near side in the finger inserting direction, and which strikes the grip unit 415 and presses the grip unit 415 downward with the movement of the pen 41.

When the pen pressing member is a plate spring 96, some room can be provided above and below the member.

As described above, when the pen pressing member is composed of the bent plate member 95 or the plate spring 96, the apparatus can be made lighter.

According to the present embodiment, the pen 41 includes the grip unit 415 and the top edge portion of the pen 41 which strikes the inclining face of the pen pressing medium is the grip unit 415. However, the configuration of the pen 41 is not limited to the above.

As long as there is a portion in the pen 41 which projects higher than the top edge portion of the pen carriage 43 and strikes the inclining face of the pen pressing member, the pen 41 does not need to include a grip unit 415.

According to the present embodiment, when the drawing starts (in other words, when the pen 41 is separated from the cap member 73), the pressure on the striking unit 721 by the pen carriage 43 is released, and the sliding member 72 accommodating the cap member 73 is pulled back to the far side in the finger inserting direction (left side in the Y-direction in FIG. 2) by the spring 74. On the other hand, the pen 41 is freed from the pressure from above by the pen pressing member 90, and the pen 41 is raised to the position where the long arm 437*b* comes into contact with the stopper 438 and stops. With this, the cap member 73 separates from the pen tip 412. However, the configuration of how the pen tip 412 separates from the cap member 73 is not limited to the above.

For example, it is possible to include a pen latching unit which latches to the top edge portion of the pen 41 and prevents the pen 41 from following the cap member 73 when the pen 41 is released from the pressure from above by the pen pressing member 90.

By providing the pen latching unit as described above, the cap member 73 can be reliably separated from the pen tip 412 even if for example, the ink around the pen tip 412 is fixed to the cap member 73, and it is difficult for the pen tip 412 to be peeled and separated from the cap member 73.

According to the present embodiment, the pen pressing member 90 is fixed, and the top edge portion of the pen 41 strikes the pen pressing member 90 when the pen 41 is moved toward the pen pressing member 90. With this, the pen 41 is pressed down. However, the configuration of the pen pressing member is not limited to the above.

For example, a pen pressing member which can move up and down can be provided above the standby position, and when the pen 41 is moved to the standby position, the pen pressing member can press down the pen 41 from above the pen 41.

A pen pressing member can be provided so as to be able to move along the finger inserting direction upward to the near side in the finger inserting direction than the standby position. In the pen pressing member, an inclining face similar to that shown in the present embodiment can be formed opposing to the pen 41. When the pen 41 is moved to the standby position, the pen pressing member can be moved from the near side to the far side in the finger inserting direction, and the pen 41 can be pressed downward along the inclination of the inclining face.

In this case, a separate actuator is provided for moving the pen pressing member up and down.

In such configuration, the pen 41 is pressed down from directly above the standby position instead of gradually pressing down the pen 41 while moving. Therefore, the cap member 73 can be positioned directly below the position where the pen 41 is pressed down, and the structure as shown in the present embodiment where the cap member 73 is moved with the pen cartridge 43 is not necessary.

Therefore, the pen cap mechanism can be a simple mechanism including only the cap member 73 and not including the sliding member 72, etc.

Second Embodiment

Next, the second embodiment of the nail print apparatus 1 of the present invention is described with reference to FIG. 11A to FIG. 11C.

According to the present embodiment, only the configuration of the pen cap mechanism and the pen pressing member is different from the first embodiment. Therefore, only the points that are different from the first embodiment are described below.

Figure 11A:
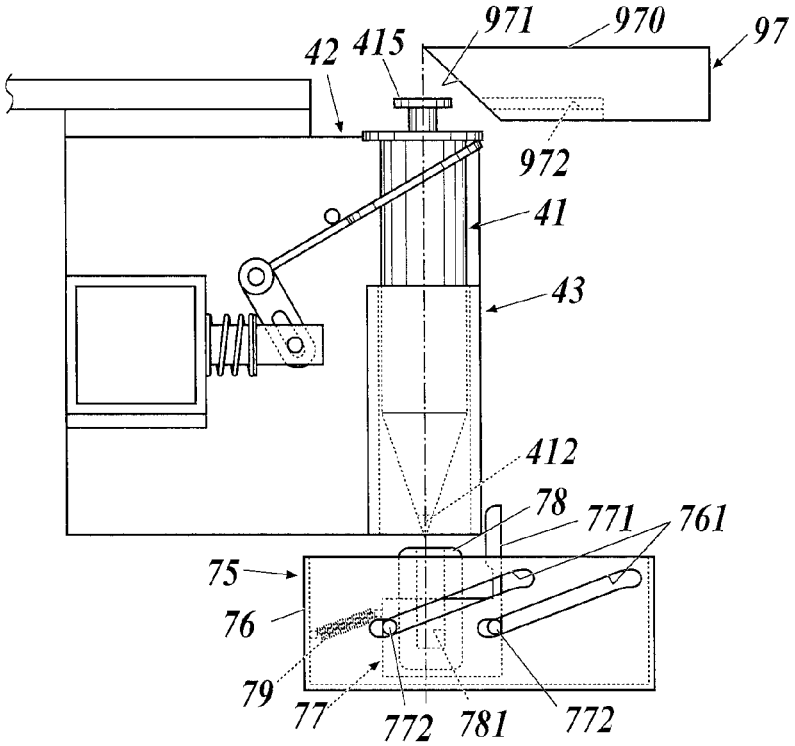
FIG. 11A is a side view showing a relation of the positions among the uncapped pen, the pen pressing member, and the pen cap mechanism in the nail print apparatus of the second embodiment.
Figure 11B:
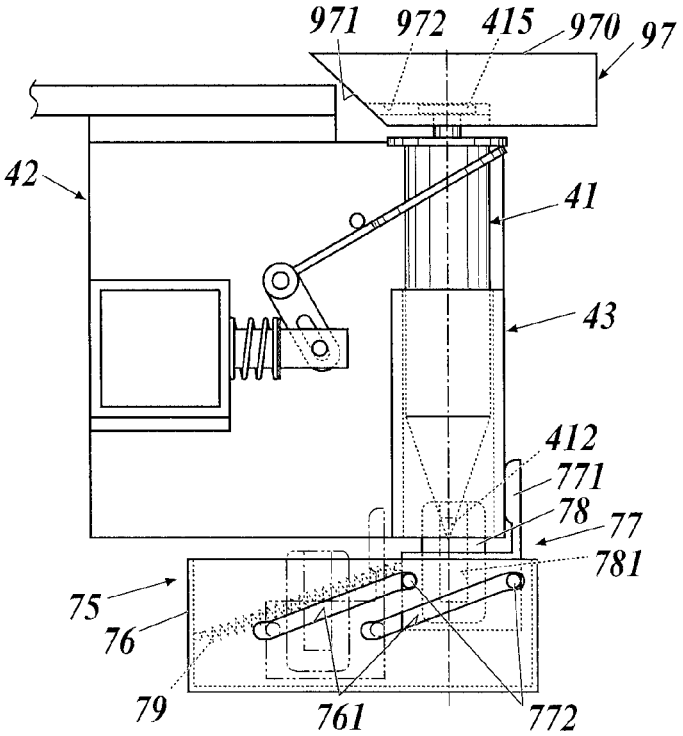
FIG. 11B is a side view showing a relation of the positions among the capped pen, the pen pressing member, and the pen cap mechanism.

FIG. 11A and FIG. 11B are side views schematically showing the pen cap mechanism, the move prevention member, and the drawing head 42 including the pen 41 of the nail print apparatus of the present embodiment.

As shown in FIG. 11A and FIG. 11B, the pen cap mechanism 75 of the present embodiment includes a pen cap mechanism outer casing 76 and a sliding member 77 accommodated in the pen cap mechanism outer casing 76.

Similar to the first embodiment, the pen cap mechanism 75 has a width which is substantially the same or larger than the width of the drawing head 42.

The pen cap mechanism outer frame 76 is a box shaped member which accommodates the sliding member 77.

On a side face of at least one side in the width direction of the pen cap mechanism outer casing 76, a long hole 761 is formed inclined upward from the far side to the near side in the finger inserting direction.

The sliding member 77 is a box shaped member accommodating a cap member 78 inside, and a plate shaped striking unit 771 is provided standing on the near side in the finger inserting direction (right side in FIG. 11A and FIG. 11B).

When the pen carriage 43 including the pen 41 is moved to the near side in the finger inserting direction, the striking unit 771 strikes the lower portion of the pen carriage 43.

Then, the striking unit 771 is pressed to the near side in the finger inserting direction due to the movement of the pen carriage 43 to the near side in the finger inserting direction. With this, the sliding member 77 slides to the near side in the finger inserting direction.

A protruding unit 772 is provided on an outer side face of the sliding member 77 in a position corresponding to the long hole 761 formed in the pen cap mechanism outer casing 76. The protruding unit 772 fits in the long hole 761.

The sliding member 77 is able to slide in the front and back direction (front and back in the finger inserting direction, left and right direction in FIG. 11A and FIG. 11B) of the nail print apparatus along the long hole 761 with the protruding unit 772 fitted in the long hole 761.

Then, when the sliding member 77 slides toward the near side from the far side in the finger inserting direction, the sliding member 77 is gradually raised upward from the far side to the near side in the finger inserting direction along the inclination of the long hole 761.

When the sliding member 77 slides toward the far side from the near side in the finger inserting direction, the sliding member 77 is gradually lowered downward from the near side to the far side in the finger inserting direction along the inclination of the long hole 761.

According to the present embodiment, two protruding units 772 are provided. However, the number of the protruding units 772 is not limited to the above.

The cap member 78 accommodated in the sliding member 77 is positioned below the pen 41 when drawing is not performed and covers the pen tip 412 of the pen 41 in the predetermined standby position.

The material used to form the cap member 78 is similar to the first embodiment.

A pen tip receiving unit 781 which is substantially a cylinder shaped hole open at the top portion is formed in the cap member 78. The number of pen tip receiving units 781 formed corresponds to the number of pens 41 attached to the drawing head 42 (for example, four).

One end of a spring 79 is attached to the outer side face of the sliding member 77 on the far side in the finger inserting direction (left side in FIG. 11A and FIG. 11B).

The other end of the spring 79 is fixed to the inner side face of the pen cap mechanism outer casing 76 on the far side (left side in FIG. 11A and FIG. 11B).

When the drawing is performed (in other words, the striking unit 771 is not pressed by the pen carriage 43), the sliding unit 77 is pulled to the far side in the finger inserting direction (left side in FIG. 11A and FIG. 11B) by the spring 79 as shown with the alternate long and two short dash line in FIG. 11B.

According to the present embodiment, when the drawing is not performed, the pen 41 moved to the near side in the finger inserting direction is in a state where a later described move prevention member 97 holds the pen 41 so that the pen 41 does not move in the up and down direction, and the cap member 78 is pushed up in the upward direction. With this, the cap member 78 is pressed to the pen tip 412 of the pen 41 in a state held so that the pen 41 does not move in the up and down direction by the move prevention member 97.

Specifically, the cap raising mechanism is composed by the head driving unit 49 which is the pen moving mechanism which moves the pen 41 in the horizontal direction and the pen cap mechanism 75.

The cap raising mechanism composes the holding/separating mechanism which moves at least one of the pen 41 and the cap member 78 (according to the present embodiment, cap member 78) in the up and down direction so that the pen 41 and the cap member 78 contact and separate from each other.

The move prevention member 97 is provided on the downstream side in the moving direction of the pen 41 which is moved to the standby position by the head driving unit 49, in other words, on the near side in the finger inserting direction. The move prevention member 97 strikes the pen 41 and holds the pen 41 so that the pen 41 does not move in the up and down direction. The move prevention member 97 functions as the move prevention member of the present invention.

For example, the move prevention member 97 is fixed to the upper portion machine casing 12 with the screw.

The move prevention member 97 is provided toward the near side (near side in the finger inserting direction, right side in FIG. 11A and FIG. 11B) than the region that the pen 41 is moved to when the drawing is performed so that the move prevention member 97 does not come into contact with the pen 41 and the pen carriage 43 when the image is drawn.

The move prevention member 97 includes move prevention units 970 corresponding to the pen 41 attached to the drawing head 42. The number of move prevention units 970 provided corresponds to the number of pens 41 attached to the drawing head 42 (for example, four).

Figure 11C:
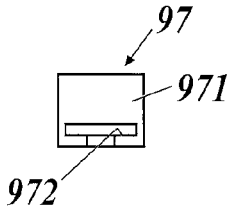
FIG. 11C is a front view of the pen pressing member.

FIG. 11C is a planar view of one move prevention unit 970 viewed from the left side in FIG. 11A and FIG. 11B:

As shown in FIG. 11A to 11C, an inclining face 971 is formed in each move prevention unit 970. The inclining face 971 is formed by cutting out the side opposing to the pen 41 from the far side in the finger inserting direction to the near side diagonally downward.

A guiding groove 972 is formed in each move prevention unit 970. The guiding groove 972 is open to the inclining face 971 and the bottom side face of the move prevention unit 970, and extends from the far side to the near side in the finger inserting direction.

The guiding groove 972 is a size slightly larger than the grip unit 415 which is the top edge portion of the pen 41.

The shape of the grip unit 415 is not limited to the illustrated example.

For example, the grip unit 415 can be a sphere shaped grip unit, etc. In this case, the guiding groove 972 is formed in a shape to match the shape of the grip unit.

The move prevention member 97 is provided so that the guiding groove 972 comes to a position corresponding to the grip unit 415 of the pen 41 when the pen 41 is moved to the standby position from the far side to the near side in the finger inserting direction.

In the standby position, the grip unit 415 of the pen 41 is inserted in the guiding groove 972. With this, the position of the pen 41 in the up and down direction is fixed, and the pen 41 is held in a state so that the pen 41 does not move in the up and down direction.

According to the present embodiment, the inclining face 971 does not need to be formed in the move prevention member 97. However, if the inclining face 971 is provided, even if the position of the grip unit 415 is misaligned a little higher than the guiding groove 972, the grip unit 415 strikes the inclining face 971, the grip unit 415 is pressed down along the inclining face 971, and the grip unit 415 is guided to the guiding groove 972. Therefore, the grip unit 415 is easily inserted to the guiding groove 972.

According to the present embodiment, when the holding/separating mechanism separates at least one of the pen 41 and the cap member 78 (according to the present embodiment, the cap member 78) from the other (according to the present embodiment, the pen 41), the guiding groove 972 is latched to the top edge portion of the pen 41, and functions as a pen latching unit which prevents the pen 41 from following the cap member 78.

The other structures are similar to the first embodiment, therefore, the same reference numerals are applied to the same members and the description is omitted.

Next, the operation of the nail print apparatus of the present embodiment is described.

The drawing operation is similar to the first embodiment, therefore, the description is omitted.

After the end of drawing, or when the drawing is not started immediately after the pen 41 is set, the drawing control unit moves the pen carriage 43 to the standby position.

Here, the pen carriage 43 is moved to the near side in the finger inserting direction.

With this, as shown in FIG. 11A, the lower portion of the pen carriage 43 strikes the striking unit 771 of the sliding member 77 and the pen carriage 43 is moved toward the near side in the finger inserting direction with the sliding member 77 while pushing the sliding member 77.

Then, as shown in FIG. 11B, the grip unit 415 which is the top edge portion of the pen 41 is inserted in the guiding groove 972 formed in the inclining face 971 of the move prevention unit 970.

When the position of the grip unit 415 is slightly misaligned upward than the guiding groove 972, the grip unit 415 first strikes the inclining face 971, and then the grip unit 415 is gradually guided downward along the inclining face 971 and is inserted in the guiding groove 972.

In a state that the grip unit 415 of the pen 41 is fitted inside the guiding groove 972, the pen 41 is held in a state so that the pen 41 does not move in the up and down direction.

Here, the pen tip receiving unit 781 of the cap member 78 moves with the pen carriage 43 positioned below the pen 41 supported by the pen carriage 43.

Then, the sliding member 77 accommodated in the cap member 78 is gradually raised upward diagonally along the long hole 761, and the pen tip 412 of the pen 41 with the position fixed in the up and down direction is gradually inserted in the pen tip receiving unit 731.

Then, in the state that the sliding member 77 finishes climbing up the long hole 761, the pen tip 412 is pressed deeply in the pen tip receiving unit 781 of the cap member 78. With this, the pen tip 412 is preferably sealed by the pen tip receiving unit 781.

When the drawing is started, the drawing control unit moves the drawing head 42 to the far side in the finger inserting direction (left side in FIG. 11A and FIG. 11B).

With this, the pressure on the striking unit 771 by the pen carriage 43 is released, and the sliding member 77 accommodating the cap member 78 is pulled to the far side in the finger inserting direction (left side in FIG. 11A and FIG. 11B) by the pulling force of the spring 79.

The pen 41 is gradually moved to the far side in the finger inserting direction (left side in FIG. 11A and FIG. 11B) together with the movement of the pen carriage 43.

Here, since the grip unit 415 is inserted in the guiding groove 972 of the move prevention member 97, the position of the pen 41 is in a state so that the pen 41 does not move in the up and down direction until the grip unit 415 completely comes out from the guiding groove 972.

Therefore, when the sliding member 77 which accommodates the cap member 78 moves to the rear side in the finger inserting direction, the pen 41 does not follow the cap member 78, and it is possible to surely separate the pen 41 and the cap member.

The other points are similar to the first embodiment, and therefore the description is omitted.

As described above, according to the present embodiment, outstanding effects similar to those obtained by the first embodiment can be obtained. Further, the following effects can also be obtained.

In other words, according to the present embodiment, the position of the pen 41 is fixed in the up and down direction by the move prevention member 97. Therefore, for example, even if the ink of the pen tip 412 is fixed to the cap member 78 and it is difficult to separate the pen tip 412 from the cap member 78 when drawing is performed, it is possible to surely separate the pen 41 from the cap member 78.

According to the present embodiment, the cap raising mechanism is composed of the head driving unit 49 and the pen cap mechanism 75, and the cap raising mechanism composes a holding/separating mechanism which moves at least one of the pen 41 and the cap member 78 (according to the present embodiment, the cap member 78) in the up and down direction so that the pen 41 and the cap member 78 come into contact with and separate from each other.

Therefore, a separate actuator, etc. does not need to be provided to move the cap member 78 in the up and down direction. Consequently, the configuration of the apparatus can be made simple and light, and the cost of the apparatus can be reduced.

According to the present embodiment, the cap raising mechanism which is the holding/separating mechanism is composed of the head driving unit 49 and the pen cap mechanism 75. However, the structure of the cap raising mechanism (holding/separating mechanism) is not limited to the above.

For example, a cap member which can move up and down can be provided above the standby position, and in a state where the pen 41 is moved to the standby position and fixed by the move prevention member 97, the cap member can be moved upward so that the cap member is pressed to the pen tip 412. In this case, an actuator is separately provided to move the cap member up and down.

According to such structure, unlike raising the cap member using the movement of the pen carriage 43, it is possible to realize a simple structure of only the cap member 78 without the sliding member 77, etc.

Further, the move prevention member 97 can also be moved along the finger inserting direction.

The embodiments of the present invention are described, however, the present invention is not limited to the above embodiments, and various modifications are possible without leaving the scope of the present invention.

For example, according to the above embodiments, the pen cap mechanism is a long unit connected as one including a width that can hold all pens 41 attached to the drawing head 42 and is provided with the pen tip receiving units in the number corresponding to the number of pens 41. However, the configuration of the pen cap mechanism is not limited to the above.

For example, a plurality of pen cap mechanisms (according to the present embodiment, four) can be provided separately for each pen 41 attached to the drawing unit 40.

The structure of the pen pressing member and the move prevention member is not limited to a structure including a plurality of pressing units and a plurality of move prevention units corresponding to the number of pens 41.

For example, a pressing unit or a move prevention unit can be provided connected as one with a width corresponding to a total width of all of the pens 41 (in other words, a width about the same as the width of the drawing head).

When a guiding groove is provided in the move prevention unit of the move prevention member as in the second embodiment, a guiding groove is provided with a width so that all of the grip units 415 of the pen 41 can be inserted.

When the pressing unit and the move prevention unit are provided as one as described above, it is possible to make the structure of the apparatus more simple, and to reduce the cost of the apparatus.

The pen raising/lowering mechanism to raise and lower the pen 41 can be structured as follows. When the solenoid is in a driving state, the non-drawing state of the pen 41 where the long arm 437*b* is raised to the position in contact with the stopper 438 is maintained. When the solenoid 435 is released, the pen 41 is in a drawing state where the pen tip of the pen 41 is lowered lower than the pen holder 431 of the pen carriage 43.

According to the above configuration of the pen raising/lowering mechanism, the solenoid is driven when the pen 41 separates from the cap member. Therefore, even if the pen latching unit, etc. is not provided separately, the pen 41 can be surely separated from the cap member.

According to the above embodiments, the front of the pen conditioning writing unit 61 (near side in the finger inserting direction, right side in FIG. 2) is the predetermined standby position, and the pen cap mechanism is positioned here. However, the standby position and the position of the pen cap mechanism is not limited to the illustrated examples above.

The standby position and the pen cap mechanism is positioned in a position which does not intervene in the drawing operation when the drawing is performed, and for example, the above can be positioned on the opposite side in the width direction of the apparatus (right side in FIG. 1).

The configuration of the drawing unit 40 is not limited to those shown in the above embodiments.

For example, the nail print apparatus can include a drawing unit provided with a rotating pen carriage which can hold a plurality of pens (for example, eight), a carriage rotating mechanism which rotates the pen carriage, and a pen raising/lowering mechanism which raises and lowers the pen held by the pen carriage.

When the drawing unit includes a rotating pen carriage which can hold a plurality of pens as described above, the drawing can be performed holding a plurality of types of pens simultaneously. Therefore, for example, it is possible to easily draw complicated and delicate designs which use many colors such as, a rainbow pattern which needs seven colors of ink, a gradation pattern which needs a plurality of types of ink with intensity gradually different from each other, an argyle pattern which uses various types of color, and the like.

According to the above embodiments, the solenoid is used as the pen raising/lowering mechanism to move the pen 41 up and down. However, the structure of the pen raising/lowering mechanism is not limited to the above. For example, a step motor, a DC motor, a motor, a ball screw or the like can be used.

According to the above embodiments, the X-direction moving stage 45 and the Y-direction moving stage 47 to move the drawing head 42 are composed by a combination of the X-direction moving motor 46 and the Y-direction moving motor 48 which are step motors, and a ball screw and a guide which are not shown. However, the configuration to move the drawing head 42 is not limited to the above.

The X-direction moving motor 46 and the Y-direction moving motor 48 are to move the drawing head 42 to the front, back, left, and right arbitrarily. For example, the configuration can use a mechanism composed of a shaft or a guide and a wire as used in conventionally low price printers, or the configuration can use a servomotor, etc.

According to the above embodiments, the pen draws the images with ink, however, the pen attached to the drawing head is not limited to pens which draw using ink.

For example, a pen including a liquid type transparent glue with or without color can be attached to the drawing head. After drawing using the above, and before the glue dries, powder type lame can be poured or rhinestones can be attached in order to obtain gorgeous nail designs.

For example, a pen including a liquid including a fragrance can be attached to the drawing head, and the image can be drawn using the above so that it is possible to enjoy nail print with fragrances.

According to the above embodiments, a plurality of pens such as four pens are simultaneously attached to the drawing head. However, for example, the pen attached to the drawing head can be only one pen, and the user can suitably exchange the pen manually as necessary. According to such configuration, the nail print apparatus 1 including a pen can be realized with low cost.

Alternatively, the apparatus can include a mechanism to exchange the pen attached to the drawing head automatically. In this case, for example, a plurality of pens are held in the standby position, the pen is selected automatically from the above, and the selected pen is attached to the drawing head. According to such configuration, the number of pens that the apparatus can hold can be further increased.

According to the above embodiments, the drawing medium used for conditioning the pen is a sheet of paper. However, the drawing medium is not limited to paper.

The drawing medium can be a roll type. In this case, a medium conveying mechanism is provided to automatically or manually roll out and roll in the drawing medium.

When the drawing medium is a roll type, a medium attaching/removing opening to attach and remove the roll of the drawing medium is provided instead of the medium insert/eject opening 24.

According to the above embodiments, the drawing data generating unit 813 calibrates the curved face in the image data of the nail design and generates the drawing data. However, the drawing data generating unit 813 generating the drawing data is not a necessary element of the present invention.

For example, instead of generating the drawing data separately, the drawing control unit 815 can control the drawing by suitably converting the image data of the nail design using an LUT (Lookup Table), etc. and outputting the image data to the drawing head to draw the image matching with the nail shape.

According to the above embodiments, the shape of the nail T is detected as the nail information, and the drawing data is generated based on the above. However, detecting the nail shape is not a necessary element of the present invention.

For example, when it is not necessary to extract the outline of the nail T to draw the image in cases such as drawing a pattern near the center of the nail T, the shape of the nail T does not have to be acknowledged accurately, and the drawing can be performed without detecting the nail shape.

The imaging apparatus is not limited to a camera 51 which captures stationary images. The imaging apparatus can be a camera which can capture moving images.

In this case, the camera captures the moving image, the image of the surface of the nail T is suitably cut out from the captured moving images and is used for detecting the nail information.

According to the above embodiments, the nail image storage region 821, the nail information storage region 822, and the nail design storage region 823 are provided in the storage unit 82 of the control apparatus 80. However, the nail image storage region 821, the nail information storage region 822, and the nail design storage region 823 do not have to be provided in the storage unit 82 of the control apparatus 80, and a separate storage unit can be provided.

According to the above embodiments, one finger is inserted in the apparatus at one time and drawing is sequentially performed in the nail print apparatus 1. However, the present invention can be applied to an apparatus which can continuously draw on a plurality of fingers.

For example, by enlarging the range that the pen can move, and enlarging the range that the pen can draw, it is possible to draw on a plurality of print fingers U1 simultaneously.

A number of embodiments of the present invention are described above. However, the scope of the present invention is not limited by the above described embodiments, and the present invention includes the scope of the invention as described in the claims and its equivalents.

What is claimed is:

1. A drawing apparatus comprising:

a carriage which holds at least one drawing tool including a bar shaped axis unit and a tip which draws on a drawing target;

a cap member which includes a tip receiving unit in which the tip of the drawing tool can be inserted and which is shaped to cover and seal the tip when the tip of the drawing tool is inserted;

a holding/separating mechanism which holds the cap member, holds the tip of the drawing tool in a sealing state sealed with the cap member when the drawing tool is placed in a standby position, and moves the cap member in a separating direction separating from the tip of the drawing tool to separate the tip of the drawing tool and the cap member from each other; and a moving mechanism which moves the carriage, wherein the drawing target is provided in a drawing region different from the standby position, wherein the moving mechanism moves the carriage to the drawing region and the standby position, wherein the axis unit of the drawing tool includes a first end and a second end, wherein the tip is provided in the first end of the axis unit, wherein the holding/separating mechanism includes a move prevention member which is fixed to a certain position, wherein the move prevention member includes a move prevention unit in which the second end of the axis unit is fitted and which limits movement of the drawing tool in an extending direction of the axis unit, wherein before the drawing starts, the holding/separating mechanism moves the cap member along a first direction in which the drawing tool and the cap member separates with the second end of the axis unit fitted in the move prevention member to separate the tip of the drawing tool and the cap member from each other, and wherein the holding/separating mechanism includes a first cap member moving mechanism which fits the second end of the drawing tool in the move prevention unit of the move prevention member, moves the cap member along a second direction different from the first direction according to the carriage being moved to the standby position by the moving mechanism, and moves the cap member along the first direction so that the cap member comes close to the tip as the carriage comes closer to the standby position.

2. The drawing apparatus according to claim 1, wherein the drawing target is a fingernail of a hand or a toenail of a foot.

3. The drawing apparatus according to claim 1, wherein the axis unit of the drawing tool includes a first end and a second end, wherein the tip is provided in the first end of the axis unit, wherein the holding/separating unit separates the tip of the drawing tool and the cap member by moving the drawing tool along a first direction so that the drawing tool and the cap member are separated from each other before starting the drawing, wherein the holding/separating unit holds a position of the cap member along the first direction in a constant position, and wherein when the holding/separating unit holds the tip of the drawing tool in the sealing state, the move prevention member comes into contact with the second end of the drawing tool and holds the drawing tool in a state where the drawing tool is pressed in a direction that the tip is inserted in the tip receiving unit.

4. The drawing apparatus according to claim 3, further comprising a moving mechanism which moves the carriage, wherein the drawing target is provided in a drawing region different from the standby position, wherein the moving mechanism moves the carriage to the drawing region and the standby position, and wherein the move prevention member includes an inclination face which comes into contact with the second end of the drawing tool in a position where the tip is separated from the cap member as the carriage comes closer to the standby position when the carriage is moved by the moving mechanism from the drawing region to the standby position, and inclines in a direction to move the drawing tool so that the tip comes closer to the cap member.

5. The drawing apparatus according to claim 4, wherein the holding/separating mechanism includes a second cap member moving mechanism which moves the cap member from a position away from the standby position along a second direction intersecting with the first direction to the standby position while maintaining a position directly below the tip according to the carriage being moved by the moving mechanism from the drawing region to the standby position.

6. The drawing apparatus according to claim 1, wherein the drawing tool includes a protruding unit in the second end, the protruding unit protruding in a direction orthogonal to an axis line direction of the axis unit, and wherein the move prevention unit includes a groove unit in which the protruding unit can be inserted from a direction intersecting with the first direction and which is formed in a shape so that the inserted protruding unit does not fall out in the first direction.

7. The drawing apparatus according to claim 1, wherein the moving mechanism moves the carriage from the standby position to the drawing region before starting the drawing, and wherein the first cap member moving mechanism moves the cap member along the first direction to be separated from the tip of the drawing tool as the drawing tool is moved away from the standby position before the drawing starts.

* * * * *